US011268780B2

(12) United States Patent
Stanziale

(10) Patent No.: US 11,268,780 B2
(45) Date of Patent: Mar. 8, 2022

(54) TRANSMISSION OF POWER FOR ARCHERY

(71) Applicant: Pasquale Stanziale, Falciano del Massico (IT)

(72) Inventor: Pasquale Stanziale, Falciano del Massico (IT)

( * ) Notice: Subject to any disclaimer, the term of this patent is extended or adjusted under 35 U.S.C. 154(b) by 0 days.

(21) Appl. No.: 16/973,713

(22) PCT Filed: Jun. 7, 2019

(86) PCT No.: PCT/IB2019/054764
§ 371 (c)(1),
(2) Date: Dec. 9, 2020

(87) PCT Pub. No.: WO2019/239269
PCT Pub. Date: Dec. 19, 2019

(65) Prior Publication Data

US 2021/0247161 A1 Aug. 12, 2021

(30) Foreign Application Priority Data

Jun. 11, 2018 (IT) ..... 102018000006176

(51) Int. Cl.
*F41B 5/10* (2006.01)
*F41B 5/14* (2006.01)
*F41B 5/12* (2006.01)

(52) U.S. Cl.
CPC ..... *F41B 5/105* (2013.01); *F41B 5/123* (2013.01)

(58) Field of Classification Search
CPC .... F41B 5/10; F41B 5/105; F41B 5/12; F41B 5/123; F41B 5/0094; Y10S 124/90
USPC ..... 124/25, 25.6, 900
See application file for complete search history.

(56) References Cited

U.S. PATENT DOCUMENTS 4,461,267 A * 7/1984 Simonds ..... F41B 5/10 124/25.6
4,562,824 A * 1/1986 Jennings ..... F41B 5/105 124/25.6
4,724,820 A * 2/1988 Chattin ..... F41B 5/10 124/25.6
4,817,580 A * 4/1989 Butterfield ..... F41B 5/10 124/25.6

(Continued)

OTHER PUBLICATIONS

International Search Report dated Jan. 10, 2019 from counterpart PCT App No. PCT/IB2019/054764.

*Primary Examiner* — Alexander R Niconovich
(74) *Attorney, Agent, or Firm* — Shuttleworth & Ingersoll, PLC; Timothy Klima

(57) ABSTRACT

Described is an archery device for transmitting power aimed at transmitting power from at least one limb to at least one arrow using at least one cam which is operatively connected to two or more flexible, substantially inextensible elements, designed to withstand tensile stress (cables and strings or tracts thereof), simultaneously operating at least one string tract and several cable tracts, the latter, in different directions to each other, wherein the net radial moment is determined by the combination of tensions and directions of the elements connected to it. This increases the design freedom when positioning the cam and reduces the friction linked to its rotation against a support, if necessary, making it possible to do without a support, thereby eliminating friction and improving efficiency.

7 Claims, 14 Drawing Sheets

(56) References Cited

U.S. PATENT DOCUMENTS

| | | | | |
|---|---|---|---|---|
| 4,993,399 | A * | 2/1991 | Chattin | F41B 5/10 124/25.6 |
| 5,535,727 | A * | 7/1996 | Helmuth | F41B 5/10 124/25.6 |
| 7,047,958 | B1 * | 5/2006 | Colley | F41B 5/10 124/25.6 |
| 7,578,289 | B2 * | 8/2009 | Norkus | F41B 5/0094 124/25 |
| 8,833,349 | B2 * | 9/2014 | Park | F41B 5/10 124/25.6 |
| 9,297,604 | B1 * | 3/2016 | Sidebottom | F41B 5/12 |
| 9,310,155 | B2 * | 4/2016 | Langley | F41B 5/105 |
| 9,354,015 | B2 | 5/2016 | Yehle | |
| 10,267,589 | B1 * | 4/2019 | Snook | F41B 5/10 |
| 10,393,470 | B1 * | 8/2019 | Popov | F41B 5/105 |
| 10,533,822 | B1 * | 1/2020 | Popov | F41B 5/123 |
| 10,612,883 | B2 * | 4/2020 | Hanson | F41B 5/105 |
| 10,767,956 | B2 * | 9/2020 | Popov | F41B 5/123 |
| 10,969,192 | B1 * | 4/2021 | Gallops, Jr. | F41B 5/105 |
| 2007/0101980 | A1 * | 5/2007 | Sims | F41B 5/10 124/25.6 |
| 2012/0125302 | A1 * | 5/2012 | Stanziale | F41B 5/123 124/25 |
| 2014/0069405 | A1 * | 3/2014 | Peacemaker | F41B 5/10 124/25.6 |
| 2015/0136105 | A1 * | 5/2015 | McPherson | F41B 5/105 124/25.6 |
| 2019/0120587 | A1 * | 4/2019 | Hanson | F41B 5/123 |

* cited by examiner

TRANSMISSION OF POWER FOR ARCHERY

This application is the National Phase of International Application PCT/IB2019/054764 filed Jun. 7, 2019 which designated the U.S.

This application claims priority to Italian Patent Application No. 102018000006176 filed Jun. 11, 2018, which application is incorporated by reference herein.

This invention relates to a power transmission device for archery aimed at transmitting power from at least one limb to at least one arrow using at least one cam connected to several cables in several directions.

A bow is a launching apparatus consisting of an elastically flexible element, hereinafter referred to as "limb", operatively connected at the ends to a flexible string, which is substantially inextensible, designed to withstand tensile stresses. The pulling of the string away from the limb loads the limb, bending it and accumulating potential elastic energy and, on release, accelerates an arrow positioned in front of the string resting on a relative median portion, for a tail portion. The limb, also where materially consisting of a single element, is functionally distinguishable into more than one limb, one for each operating portion which is drawn and moves during the operation; typically, a bow is gripped by a rigid median structure, known as a "riser", which supports limbs positioned in a mirror-like fashion and fixed to said riser at one end, whilst the other end is bent. The limb is at the same time the source of energy and transmission of power integral in its implicit leverage when this moves the limb ends in the loading or launching direction. The string is the element for transmission of power and propulsion of the arrow. A crossbow is a bow mounted on a shaft designed to keep the string spaced with respect to the limb, opposing the force acting on the string and also provided with a mechanism for releasing the string. In the recurve bows, the ends of the flexible element extend with opposite curvature. This alters the transmission of power from the limbs to the arrow. In the compound bows the working ends of the bow support, in a pivoted fashion, axes of rotation at right angles to the working surface of the limbs, cams associated in a rotary fashion unwind the string by traction, when loading the bow, and unwind a flexible cable, which is substantially inextensible, designed to withstand tensile stress, which is operatively distinct and typically with a different force arm, connected to at least one limb or a static anchoring or through linkage devices or transfers. These cams, typically with eccentric windings, allow a variation of the transmission ratio and the force/draw curve of the portion of string drawn when loading and pushing the arrow during the launching. It should be noted that the rotation of the cams against their support causes friction; this is undesirable.

The American patent application, abandoned, US20120125302A1 deposited in December 2011 discloses cams which rotate more than 360° and wind in a helical fashion two cable tracts which are superposed along an axis parallel to the axis of rotation, located, respectively, on one face and on the other face of the string guide, suitably inclined with respect to the plane of the string in such a way as to support the helical winding. U.S. Pat. No. 9,354,015 (application Ser. No. 14/107,058 of December 2013) returns to the same disclosure.

Further, in the bows, the movement for loading and launching the arrow, the so-called "draw-length", with reference to the loading step, or similarly "power stroke", with reference to the launching step, is limited by the fact that the bow is gripped in a median zone, just below the axis of the arrow and coinciding with the plane of the string. This means that the string is necessarily behind the handgrip to prevent interference with the hand or forearm supporting the bow. Also, in view also of the limitation of the distance which each user expresses between the hand gripping the bow and the hand drawing the string, there is a strong limitation of the design and operating parameters.

The aim of this invention is to reduce or eliminate said friction, extending the draw-length which an archer can express and allow further advantages. This is achieved by providing a device according to the present disclosure. Secondary features of the invention are defined in the present disclosure.

A cam according to the invention is an element rotatable about an axis 'z' designed to wind and unwind at least three tracts of at least one cord (or other inextensible flexible element including strings and cables), by rotation induced by the tensions on these tracts. At least a portion of said at least one cord is stably connected to the cam. At least three tracts of said cord extend from the cam with an inclination (relative to the plane of rotation) and radius (distance at right angles to the axis 'z') which can vary during rotation and differ for each tract. The windings may be planes less than a turn or a spiral or helical with any number of revolutions, even with variable radius and pitch. At least one of said string tracts and the other at least two are tracts at least one of which is operatively connected to a limb to draw it and vary the accumulated elastic energy. The at least two cable tracts not being superposed vertically (along an axis parallel to 'z'), for at least a part of the operating cycle.

According to an embodiment, two cams are arranged along two cables taught between two limbs. Each cam stably captures a portion of each of the tracts against relative sliding, and an end portion of a same string. In a first step, for loading, the traction of the string rotates each cam which surrounds each four cable tracts in two directions not superposed along an axis parallel to that of rotation. In this way, each cam rotates and translates and pulls with it the closest limb. In the reverse rotation, upon release of the string, the traction by the limbs, unwinds these cable tracts, inducing the rotation of each cam, recalling the string for winding and pushing the arrow nocked on the string. This is advantageous since it eliminates the friction due to the rotation of the cam against its support.

According to an embodiment, two cams are positioned each along a taut cable between a limb and a static anchoring point and duplicated on each side of the string plane. Each cam is operatively connected with four cable tracts and one string tract. During each step, for loading or launching, cable tracts are simultaneously unwound and wound for each cam. Further, each cam rolls against a guide with a portion of its axial extension. This is advantageous since it eliminates the friction due to the rotation of the cam against its support and it also stabilises the cam and provides a further method for modifying the force/draw curve.

According to an embodiment, a single cam with an axis of rotation parallel to the working plane of the limbs is connected to four cable tracts and two tracts of a same string. The cam, and therefore also the string in its median portion, translates longitudinally during the operation from an initial position in front of the handgrip to a rear position, rolling against two guides.

The handgrip is offset transversally relative to the arrow and the plane of the string. This allows a greater elongation (therefore, launching stroke of the arrow) with the same maximum distance between the handgrip and the hand drawing the string; this improves the efficiency of the bow.

Moreover, the totally energy which the archer is able to load on the bow with maximum force is increased.

Further advantages and features of the invention are apparent from the following detailed descriptions of its preferred embodiments, presented by way of a non-limiting example, where each of them may have one or more of the advantages indicated or others.

Reference will be made to the accompanying drawings, in which.

Figure 16A:
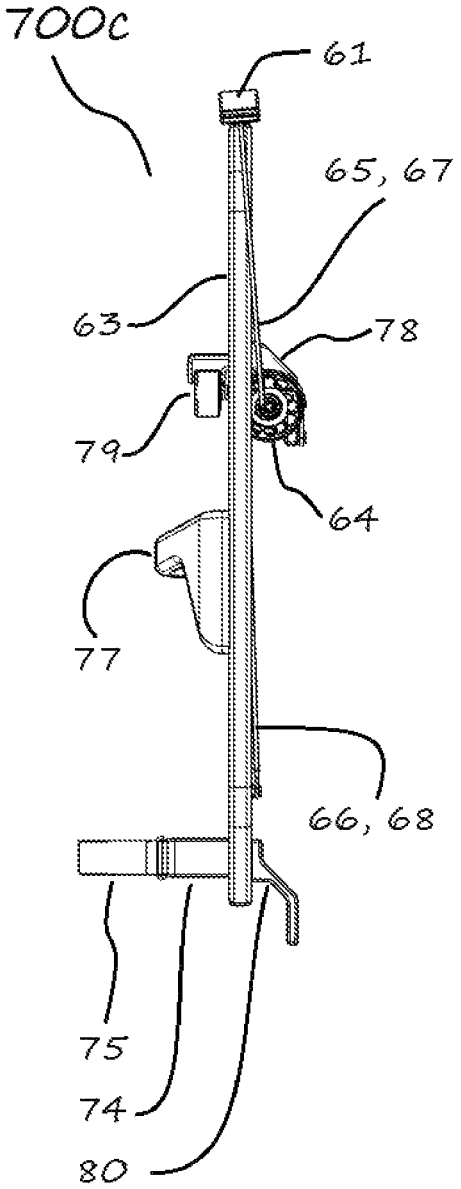

FIG. 16*a* illustrates a right-angled view from above of the third embodiment in an initial condition.

Figure 16B:
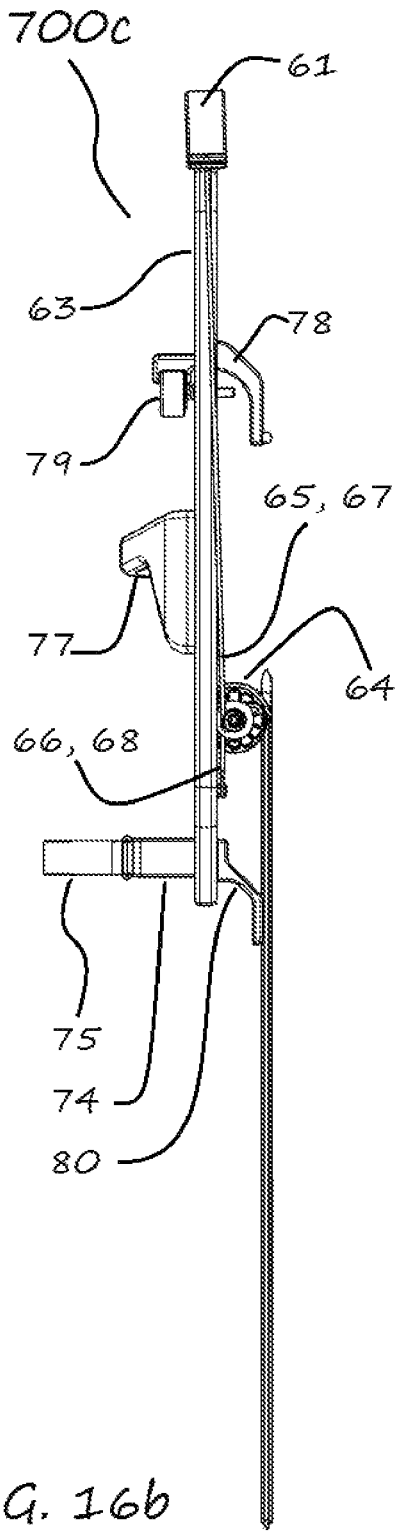

FIG. 16*b* illustrates a right-angled view from above of the device of FIG. 16*a* in a loaded condition.

Figure 17A:
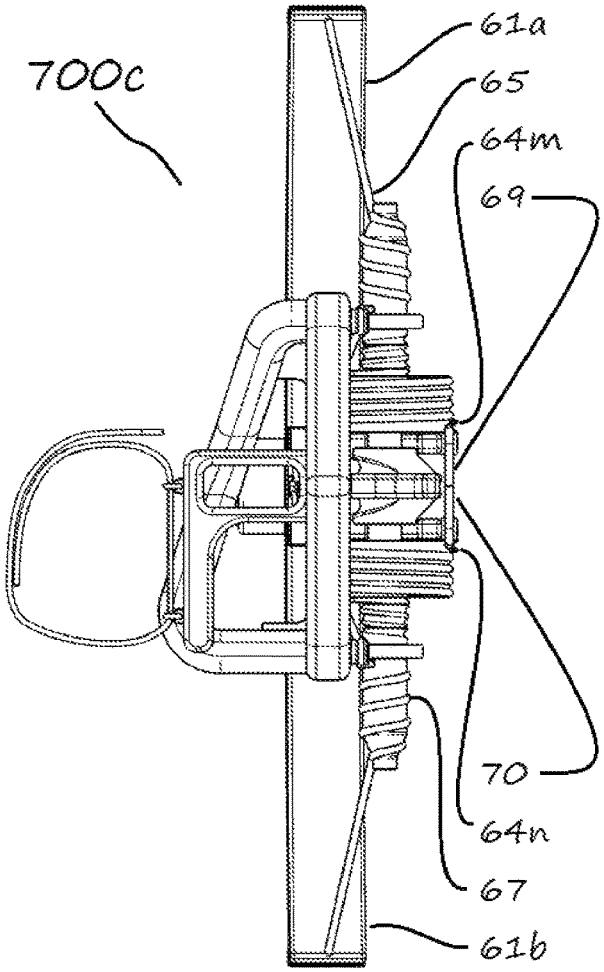

FIG. 17*a* illustrates a rear right-angled view of the third embodiment in an initial condition.

Figure 17B:
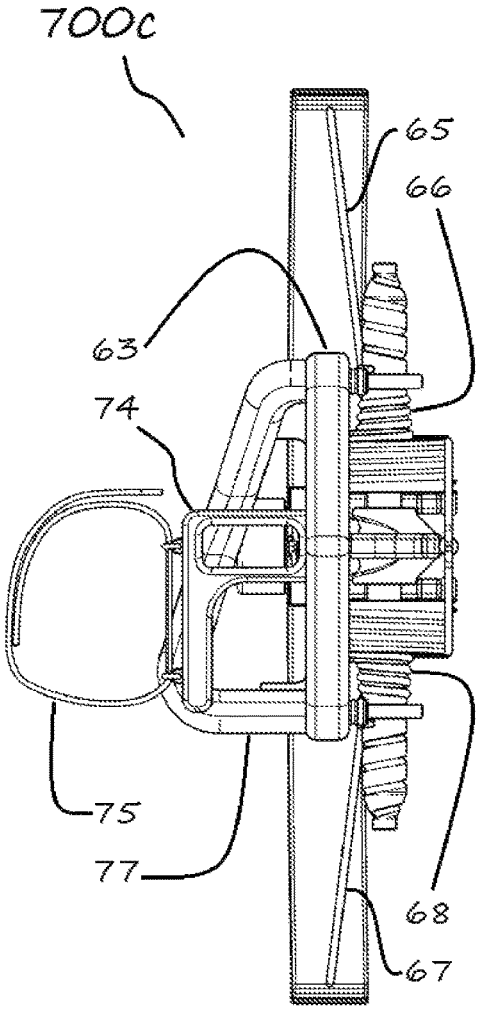

FIG. 17*b* illustrates a rear right-angled view of the device of FIG. 17*a* in a loaded condition.

Figure 5:
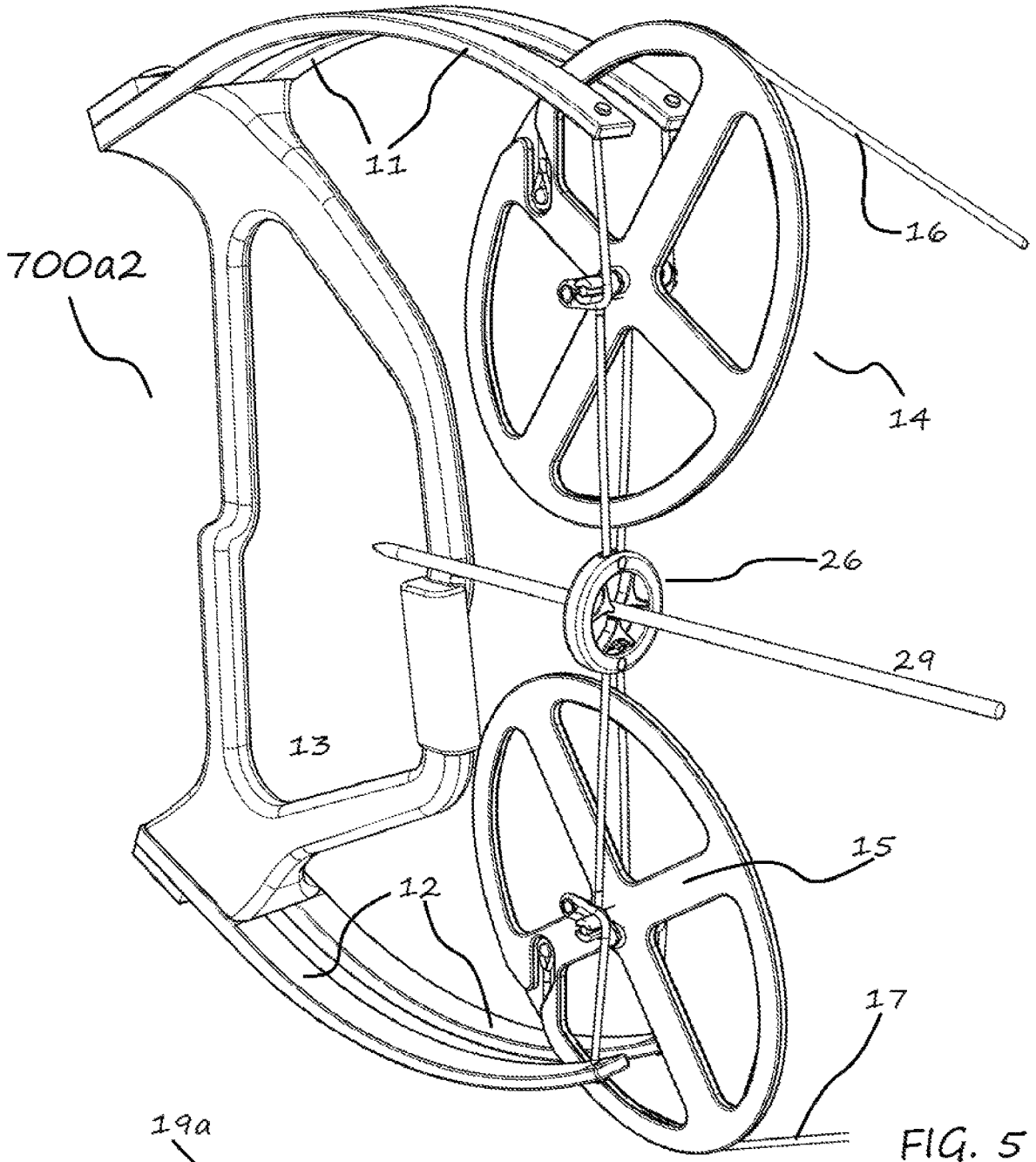
FIG. 5 illustrates a partial view of a variant of the first embodiment in a loaded condition.
Figure 6:
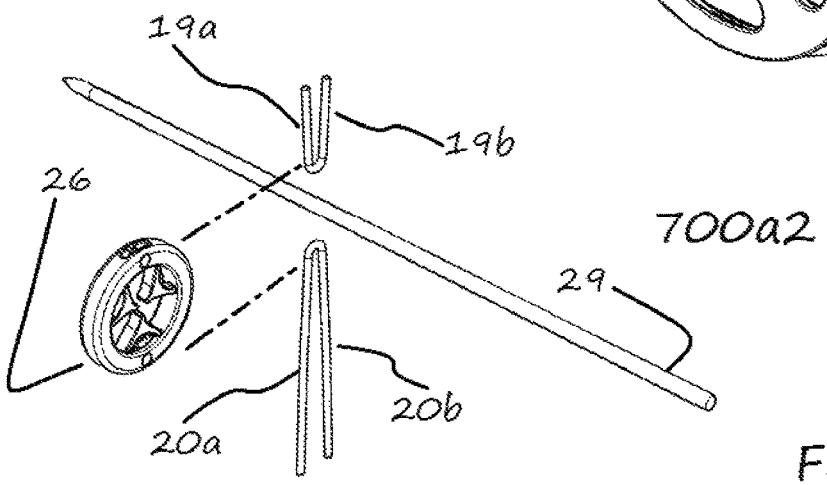
FIG. 6 illustrates a detail of FIG. 5 with components separate and spaced apart.
Figure 7:
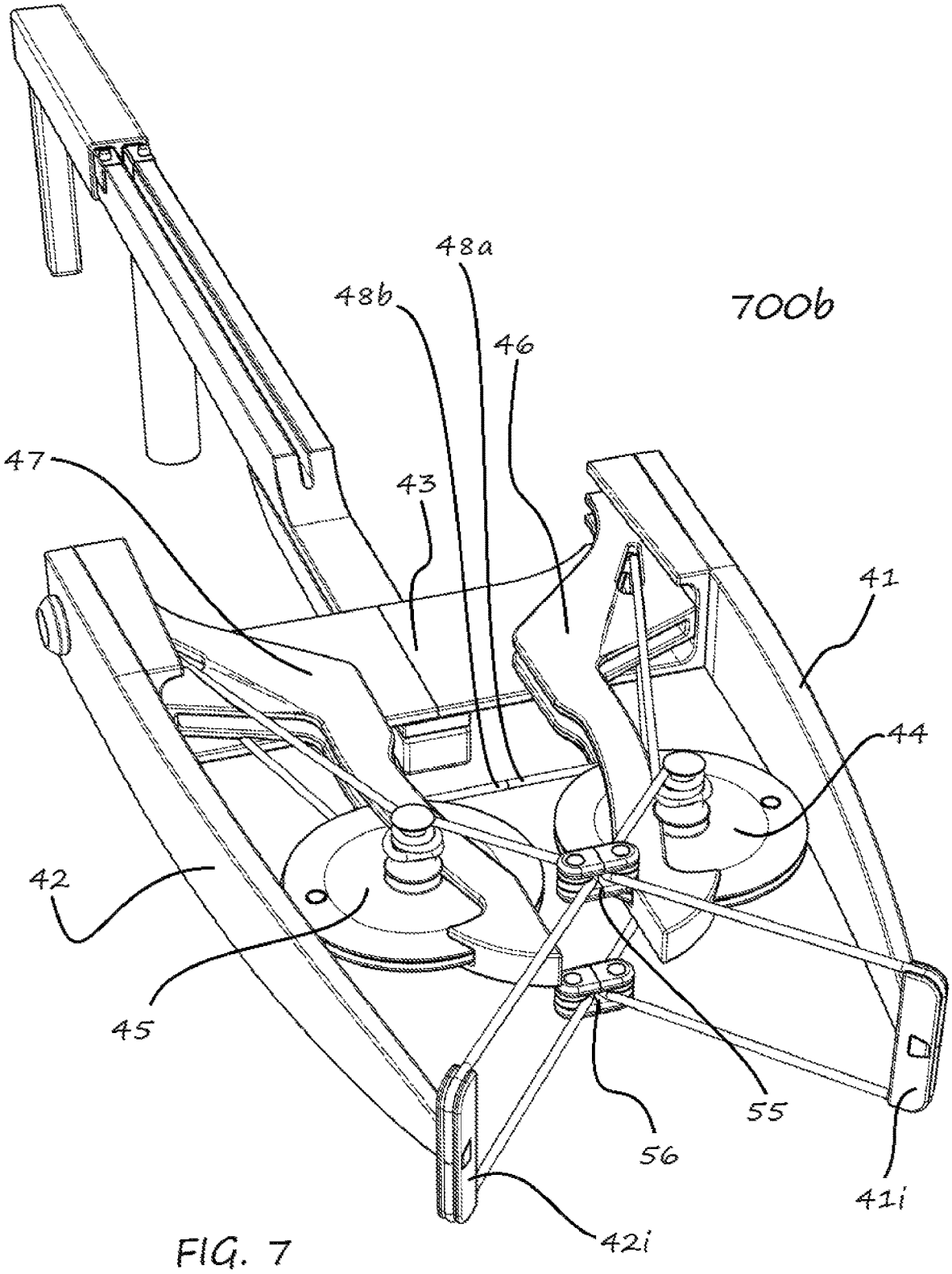
FIG. 7 illustrates a front upper perspective view of a second embodiment, in the form of a crossbow, in an initial condition.

A first embodiment, labelled 700*a*, in the form of bow, is described below with reference to FIGS. 1 to 6, and according to the typical vertical orientation of the bending plane of the limbs. The description and drawings refer to right-handed bow which is gripped with the left hand and wherein the right hand engages the string by pulling it; a bow for left-handed persons would be specular around a longitudinal vertical plane, at least in the riser, 13. An arrow with a simplified design 29, in FIGS. 3, 4, 5 and 6, is to be considered as prior art and representing any object to be launched. Said arrow 29 must be considered as supported by an element fixed to said riser 13 according to the prior art and not illustrated. Said device 700*a* includes a rigid frame, 13, the so-called "riser", limbs 11 and 12 respectively upper and lower around a horizontal plane intersecting the axis of the arrow, divided into 11*a* and 12*a*, those to the left, and 11*b*, 12*b*, those on the right. Said limbs, of substantially equal characteristics, are fixed to the riser 13 in a front end portion and are free to bend, for another spaced portion, projecting with respect to the riser. The bow including two cams, 14, 15, respectively with axes of rotation 14*z* and 15*z*, each operating simultaneously a string tract, respectively 16 and 17, and four cable tracts, 18, 19, 20, 21, respectively extended from the limb 11 to the cam 14, from the latter towards the horizontal midplane, from there to the cam 15, and from there to the limb 12. Said cable tracts duplicated to the left and to the right of the vertical transit plane of said string tracts 16 and 17, and labelled with the suffix 'a' for those to the left and 'b' for those to the right. In fact, the tracts 18*a*, 19*a*, 20*a* and 21*a* form a single cable ("18*a*-19*a*-20*a*-21*a*"), and those from 18*b*, 19*b*, 20*b* and 21*b* form another single cable ("18*b*-19*b*-20*b*-21*b*"). Similarly, the string tracts 16 and 17 form a single string element (16-17). Each cam 14 and 15 is suspended on said cables and stably houses a transit portion 22*a*, 22*b*, for said cam 14, and, similarly, 23*a*, 23*b*, for said cam 15, which pass through a central body 14*p* of said cam 14 close to said axis of rotation 14*z* and 15*p* for said cam 15, and they are held in position by coaxial screws 27*a*, 27*b*, and 28*a*, 28*b*, respectively, to prevent relative sliding. Elements 14*a* and 14*b*, mounted on opposite sides of said central body 14*p*, which are integral in rotation, are cable guides for the initial step of their winding imposing an axial clearance and a radial deviation aimed at favouring the helical winding and varying the transmission ratio, that is, the force/draw curve. The same occurs for said cam 15, body 15*p* and guide elements 15*a* and 15*b*. Therefore, said two cables, 18*a*-19*a*-20*a*-21*a* and 18*b*-19*b*-20*b*-21*b*, connect said opposite limbs on the same side of the string plane, 11*a* with 12*a* and 11 *b* with 12*b*, passing through both cams. With respect to each of said cams, 14 and 15, observing along an axis parallel to said axis of rotation 14*z* or 15*z*, the four cable tracts connected to it come from two different directions; a direction towards the closest limb and the other almost opposite, at an angle of approximately 180°, towards the horizontal median plane and the other cam. Further, said cable tracts 18*a*, 19*a*, 20*a*, 21*a*, 18*b*, 19*b*, 20*b*, 21*b* have an inclination with respect to the plane of rotation aimed at facilitating the winding in a helical fashion around the portions of said cams 14 and 15. A gate diverter element, 25, is suspended on the cables, interposed between the two cams 14, 15, maintaining an inclination for the tracts 19*a*, 20*a* and 19*b*, 20*b*, and maintaining an opening for the passage of the arrow. FIGS. 5 and 6 show the device 700*a*2, a variant embodiment of 700*a*, for implementing a different gate diverter element 26 in place of 25, imposing a different path for the cables, where the cable tract 19*a* is returned onto the opposite side (on the right) joining with the tract 19*b* and 20*a* is returned to the tract 20*b*. The tracts 18*a*, 19*a*, 19*b*, 18*b* (in that order) form a single cable element and the tracts 21*a*, 20*a*, 20*b*, 21*b* (in that order) form another single cable.

Therefore, in the variant device 700*a*2, said cables do not pass through the horizontal plane intersecting the arrow. Moreover, said diverter gate 26 is suitably formed to slidably support a portion of the arrow. This feature not being exclusively associable with said diverter gate 26 or to a particular path of the cables.

Figure 1:
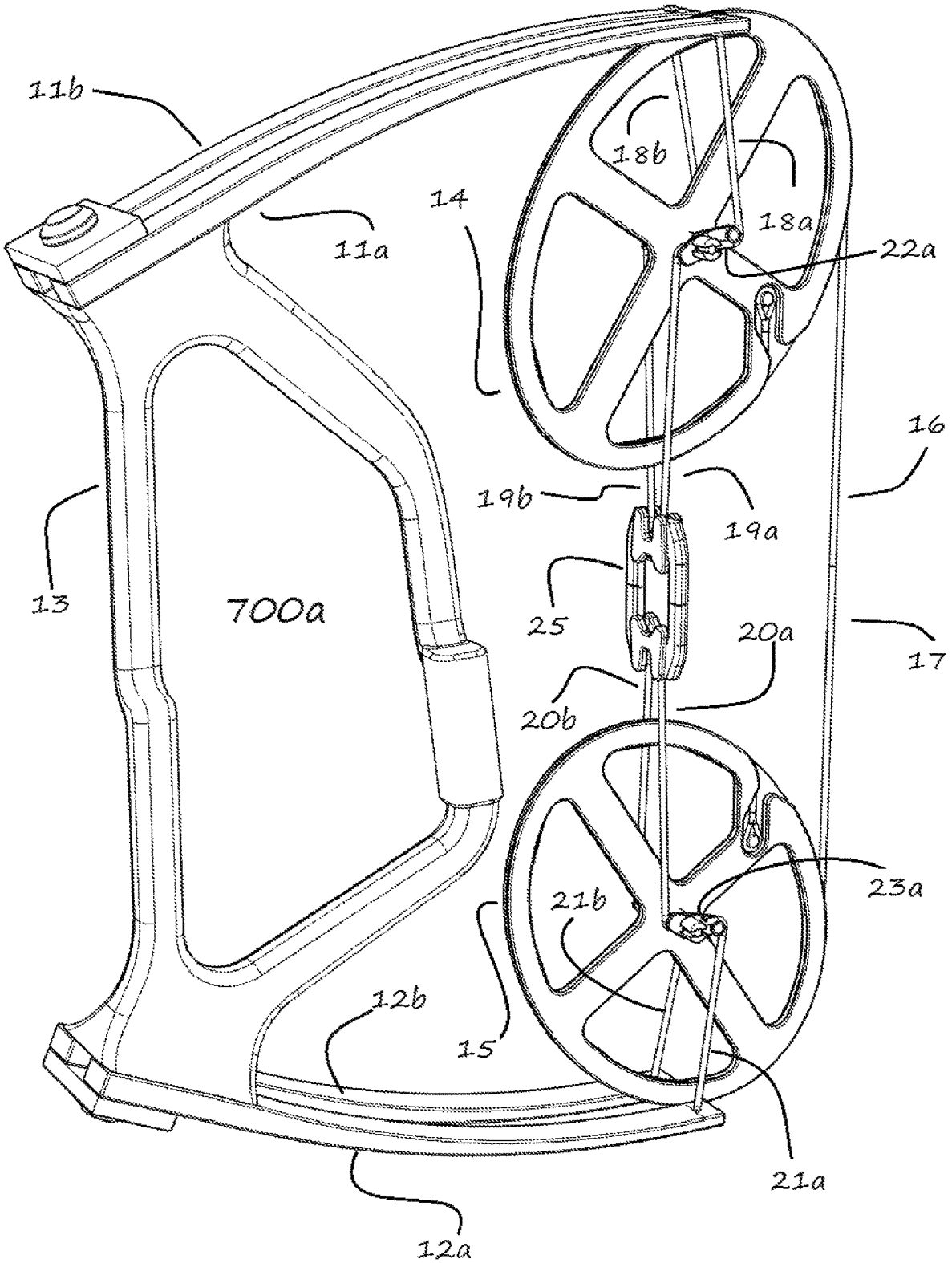
FIG. 1 illustrates a front left perspective view of the first embodiment, in the form of a bow, in an initial condition.
Figure 2:
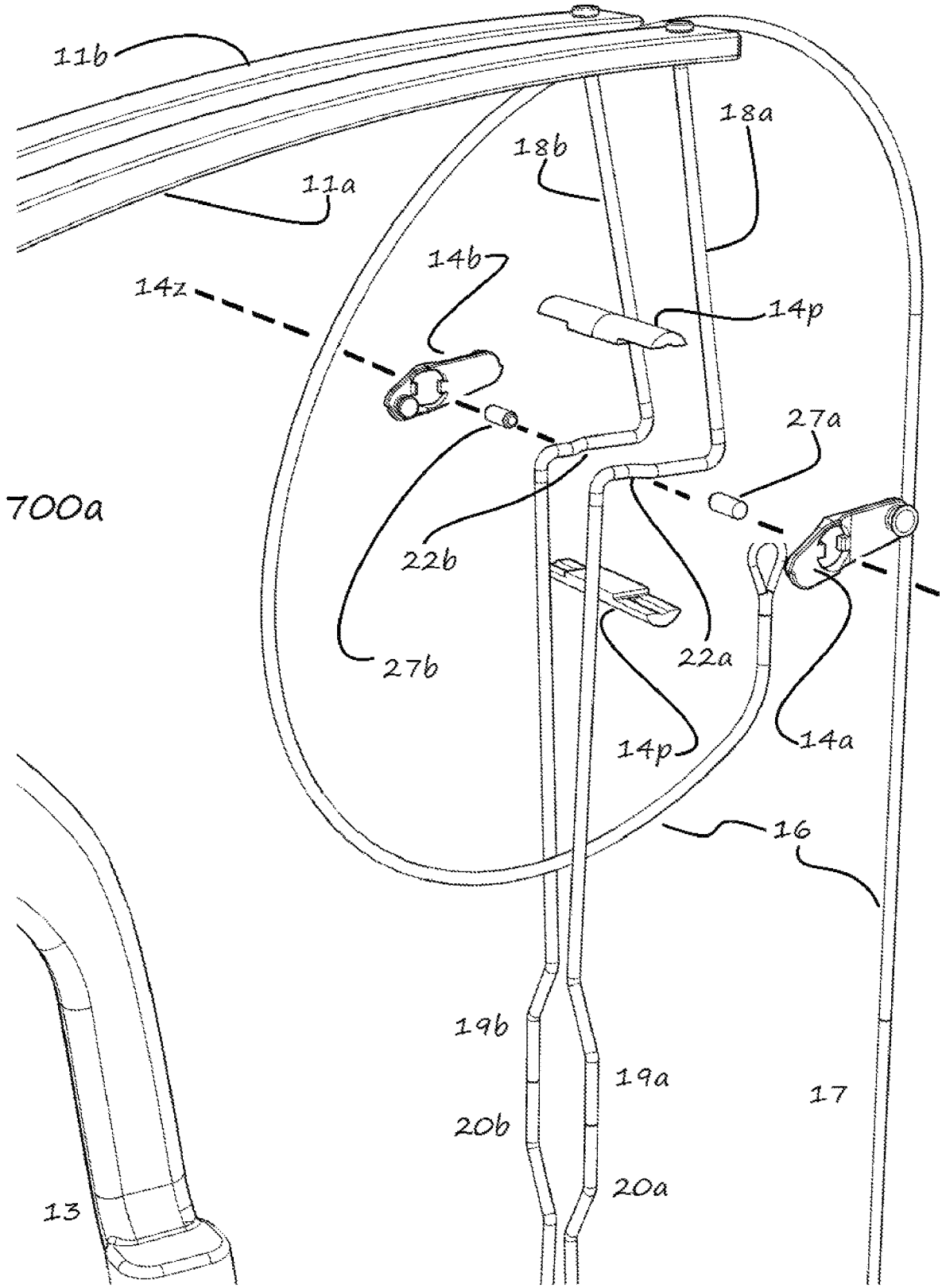
FIG. 2 illustrates an enlarged detail of the device of FIG. 1 with some elements removed, cut and spaced, and with components detached and spaced apart.
Figure 3:
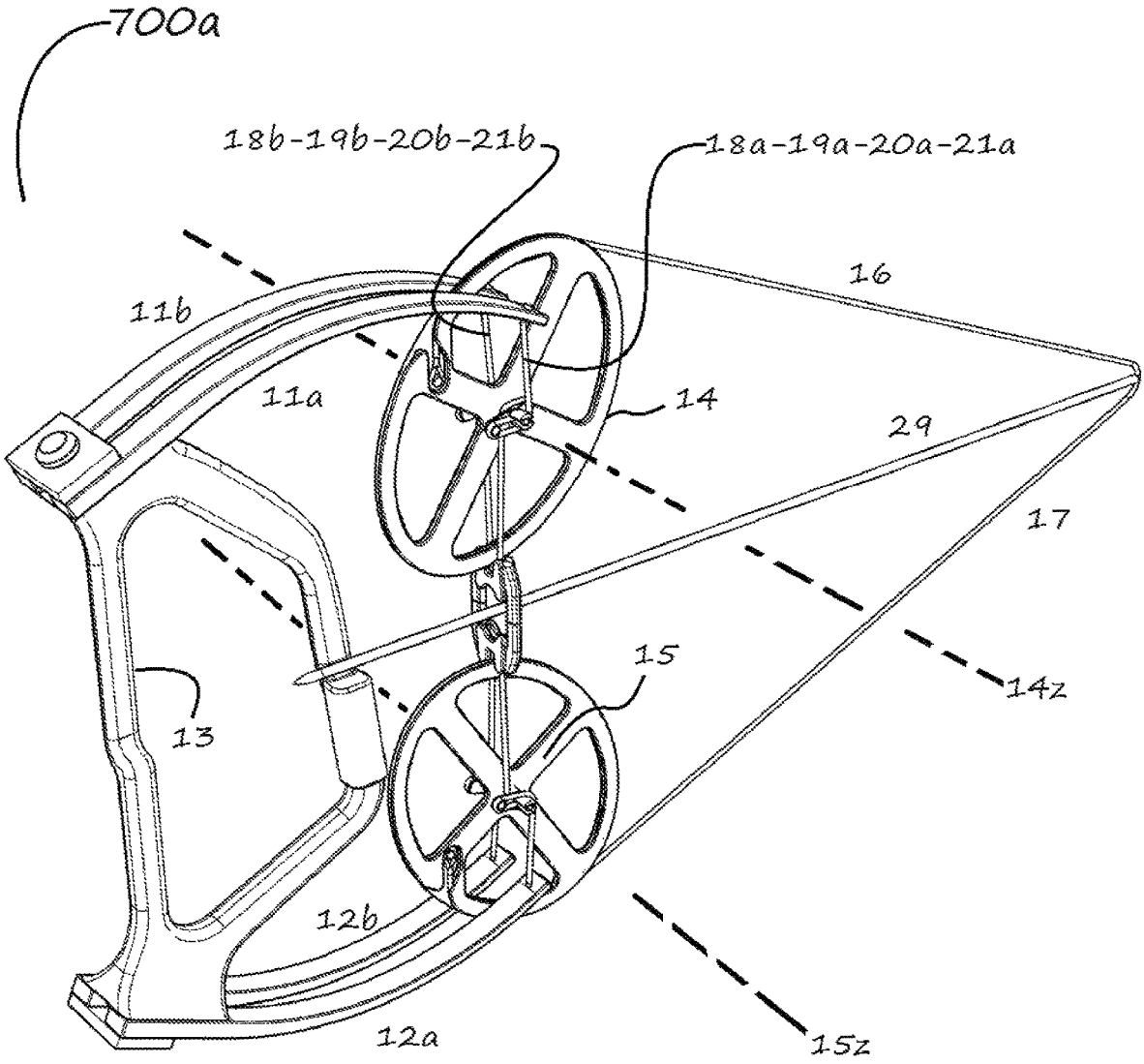
FIG. 3 illustrates the device of FIG. 1 in a loaded condition and an arrow with a simplified design.
Figure 4:
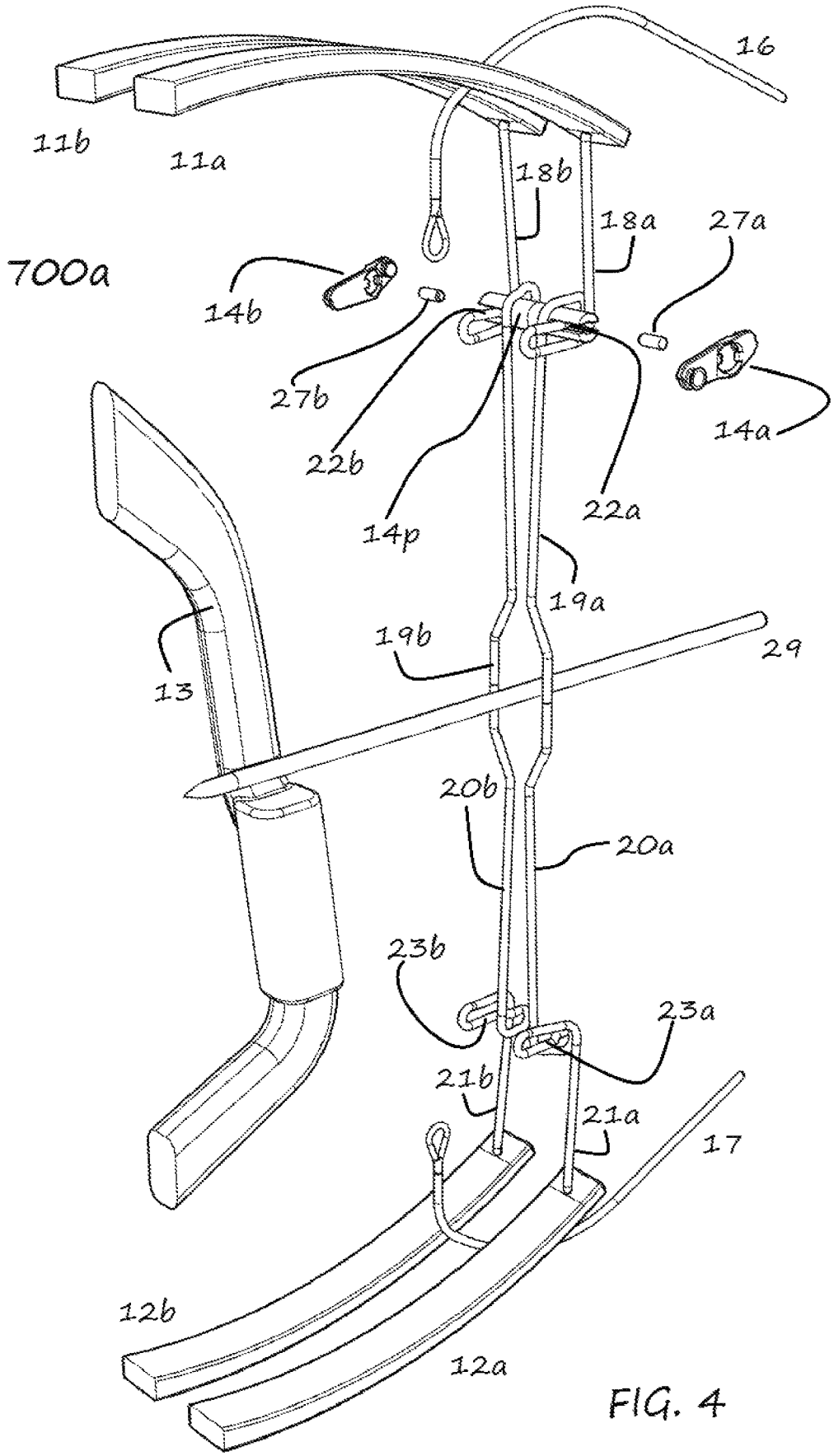
FIG. 4 illustrates a partial and enlarged view of the device of FIG. 3, with some elements removed, with components detached and spaced apart.

Operation. In an initial condition, illustrated in FIG. 1, the limbs 11, 12 are preloaded and tension on the string 16-17 prevents rotation of the cams under the action of said two cables 18*a*-19*a*-20*a*-21*a* and 18*b*-19*b*-20*b*-21*b*. A prior art arrow, 29, is nocked on a median portion of the string 16-17 and said string 16-17 is engaged by the archer with the fingers or by means of a prior art releaser, for being pulled away from said riser 13. The pulling of the string 16-17 imparts a moment of rotation of the cams 14 and 15 which force the four cable tracts 18*a*, 19*a* and 18*b*, 19*b* to wind around said first cam, 14, and those 20*a*, 20*b* and 21*a*, 21*b* around said second cam, 15, according to irregular helical paths, of variable radius and spacing, determined by their shape, by the inclination of the cable tracts and by the distance from the respective anchoring or diverting points. The loading condition, shown in FIG. 3, is reached after approximately half a rotation of the cam. During loading, each cam 14 and 15 translates with its axis of rotation 14*z* or 15*z* towards the opposite one for a distance and simultaneously pulls towards it the closest limb for winding the relative cable tracts 18 or 21. This occurs simultaneously for both the cams 14, 15 and said limbs 11*a*, 11*b*, 12*a*, 12*b*. The working end of the limb moves by a distance given by the sum of the two above-mentioned movements. When the string 16-17 is released it is accelerated to rewind around its guide with opposite movements. The device 700*a*2 (FIGS. 5 and 6) is functionally similar to the element 26 which transmits the tension force between the upper half, maintains a passageway for the passage of the arrow 29 and supports it during various operating steps.

This embodiment is advantageous since the cam is suspended on the cables and eliminates the friction due to its rotation against a support. In addition, the stresses on the housing resulting from the net radial moment of force are eliminated, especially in the end of stroke shock when all the moving parts during launching reach the end of stroke, discharging the residual energy in zero distance. The working portion of the limbs can be thinner and lighter and bearings and bushings are eliminated. The translation of said cams 14 and 15, with their said axes 14*z* and 15*z*, is shorter than that of prior art cams fixed to the limbs. Production costs, inertia and friction are reduced.

According to another variant not illustrated, cams according to the invention could be pivoted to extensions of the structure 13 to which the limbs are fixed or to an element suspended between the cables, and several cable tracts wound or unwound in at least two different directions on the plane of rotation, each connecting the cam with a limb, where no cable is shared with several cams and therefore only the limbs would move with respect to this pivoting, whilst maintaining the configuration and the advantages described since the net radial moment is in any case suitably reduced, and the translation is zero.

A second embodiment, labelled 700*b*, in the form of a crossbow is illustrated in FIGS. 7 to 11 and is described below with reference to the typical horizontal orientation of the bending plane of the limbs during use.

Figure 8:
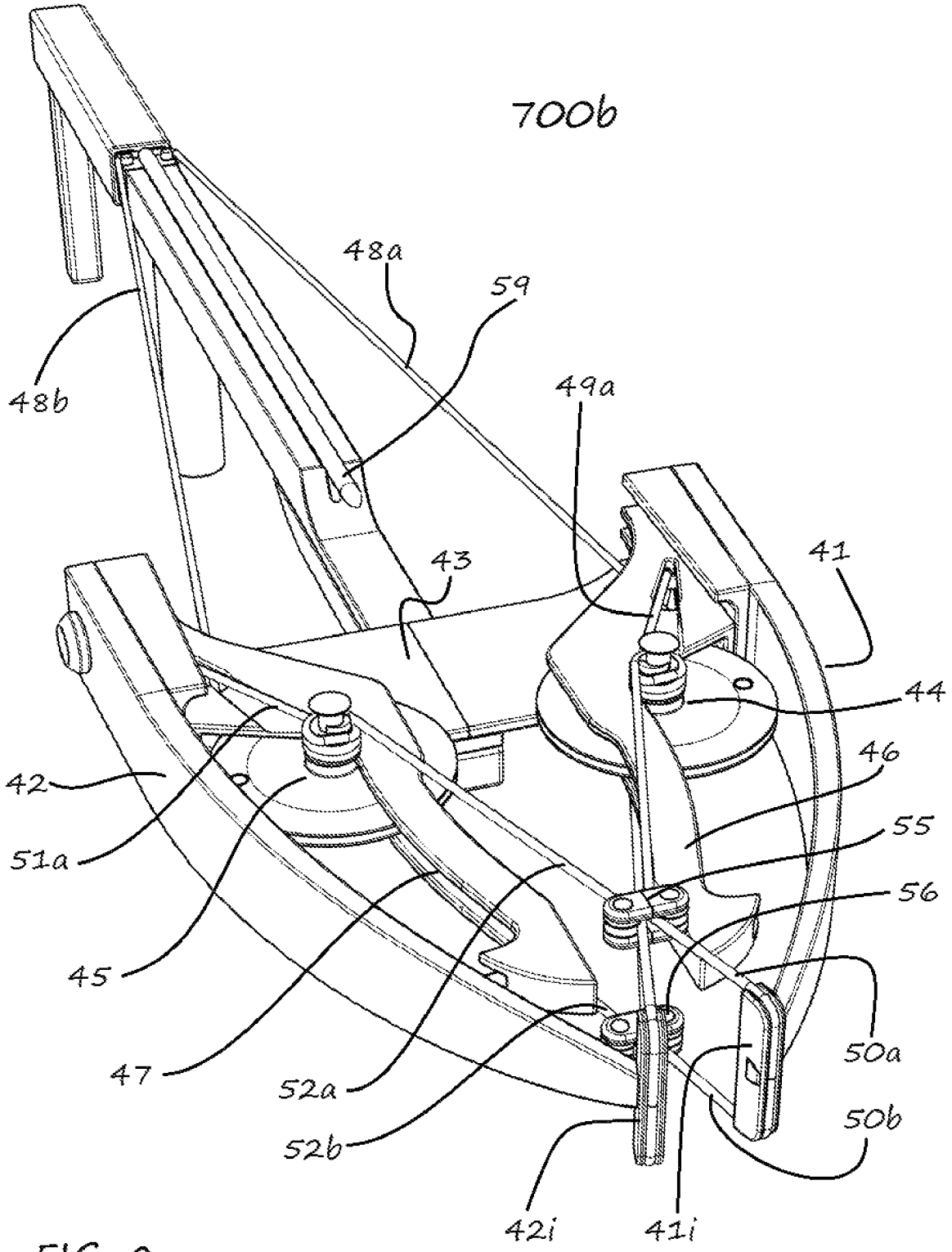
FIG. 8 illustrates the device of FIG. 7 in a loaded condition.
Figure 9:
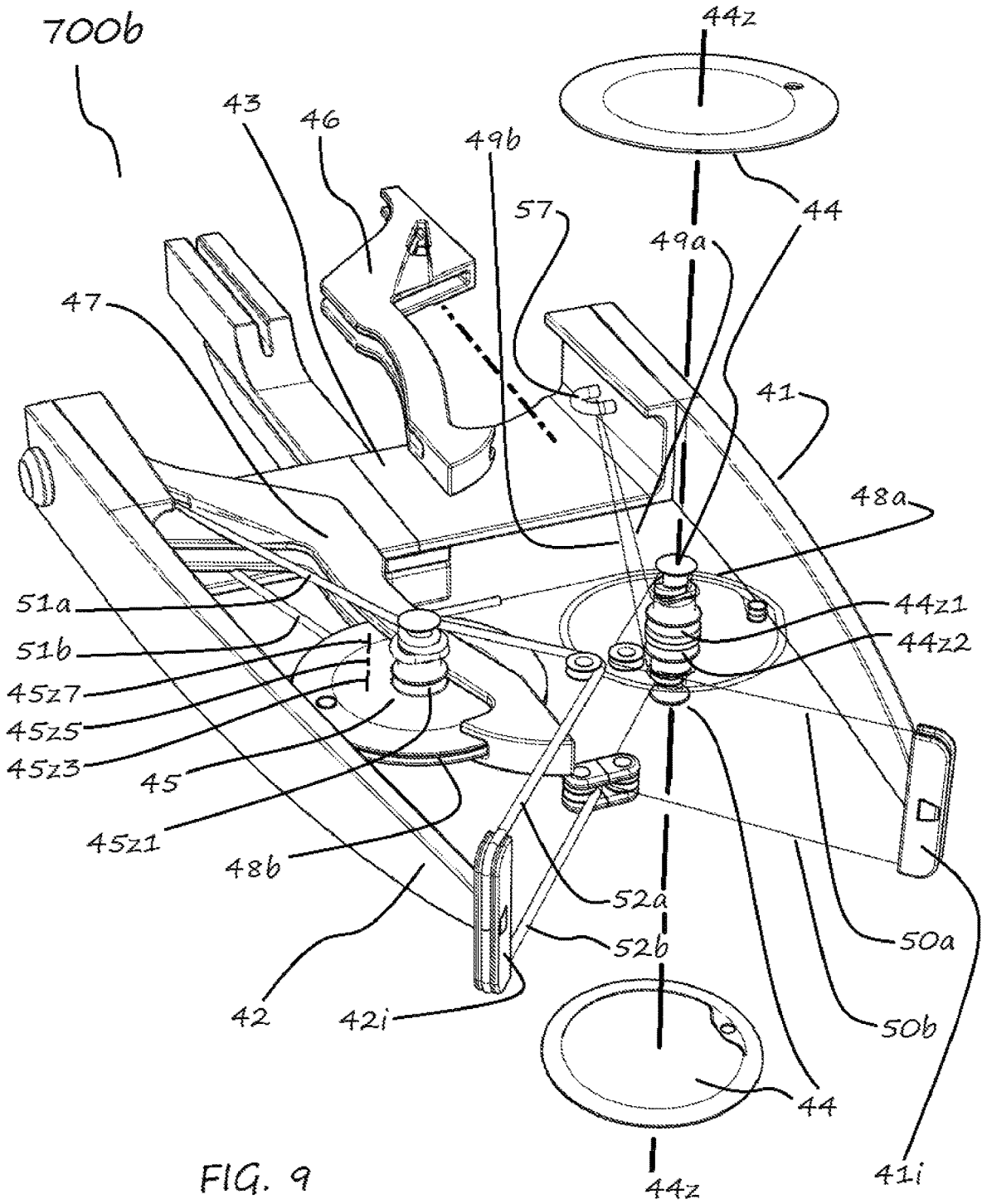
FIG. 9 illustrates a partial and enlarged view of the device of FIG. 7, with some elements removed, cut or simplified, with components detached and spaced apart.
Figure 10:
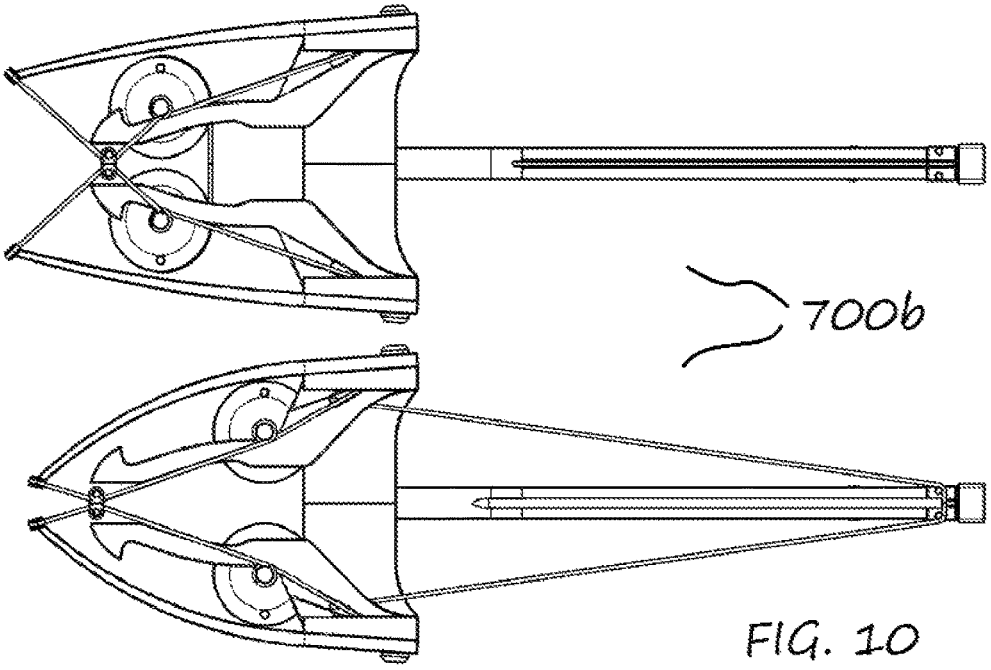
FIG. 10 shows two examples side-by-side of the second embodiment with right-angled, vertical views from above and, respectively, in an initial and loaded condition.

An arrow with a simplified design 59 in FIGS. 8 and 10 is to be considered as prior art and representing any object to be launched. Said device 700*b* consists of bow assembly connected to a shaft equipped with a handgrip, butt, string release; only the bow assembly is described whilst the remaining components illustrated in the drawings for reference are to be assumed as prior art. In any case, the device described below can be considered to be any structure suitable for maintaining a space between the bow assembly and a portion of the string designed to push an arrow, in a configuration with the device loaded, that is to say, functionally, a crossbow regardless of any of its other characteristics. Said second embodiment includes a riser 43, fixed to a shaft. Said riser 43 supporting two coplanar limbs 41, 42, positioned in a mirror-like fashion, respectively to the left and to the right of a vertical plane intersecting the longitudinal axis, projected forwards and converging such that they move away from their supports on said riser 43, substantially in the direction of launching the arrow, move towards each other. Said limbs 41 and 42 each support in the front end zone, free to bend, a connection element 41*i* and 42*i*, respectively, aimed at allowing the engaging by cables in order to draw them by bending. Two cams 44, 45, with axes of rotation 44*z* and 45*z*, respectively, are positioned in a mirror-like fashion relative to a vertical longitudinal plane, in the space delimited by the two limbs 41 and 42, and such as to roll against a pair of split guides 46 and 47 fixed to said riser 43 and projecting forwards. Limbs 41, 42, cams 44, 45 and guides 46, 47 conveniently centred on the launching axis of the arrow and substantially mirror-like with respect to a horizontal median plane including the launching axis of the arrow and also with respect to a vertical median plane including the launching axis of the arrow. Each cam is rotatably interfaced with a string tract 48*a* or 48*b* and four cable tracts. A pair of cable diverter elements 55 and 56 each including pair of cable guide wheels, are suspended on left and right cable tracts, one above and the other below the string plane 48. These are designed to allow the pulling of the working end of the limbs with an angle close to 90° whilst at the same time containing the maximum width and avoiding the drawbacks due to left-right crossing (with superposing) of the cables. As more clearly illustrated in FIG. 9, the string tracts 48*a* and 48*b* form a single continuous string element (hereinafter referred to as 48*a*-48*b* or simply 48, collectively). Each of the tracts 48*a* and 48*b* is wound in the form of a spiral for 2.25 turns (two and a quarter turns) around the guide of each cam 44, 45, whilst the crossbow is in an initial condition, with minimum accumulated energy, and is fixed to said cam 44 or 45 with an end portion. The cam 44, on the left of the launching axis, from the point of view of the user, is operatively connected to the cable tracts 49*a*, 50*a*, above the string plane, and 49*b*, 50*b*, below. Said tracts 49*a* and 49*b* connect an anchor point 57, on the static structure of the device, in particular on the riser, in a retracted position with respect to said cam 44, to said cam 44 on the same left side. Said tracts 50*a* and 50*b* connect said cam 44 at the working end of the limb 41, placed in a more advanced position, on the same left side, capturing a front end portion by means of the connecting element 41*i*, passing left portion of said elements diverts cables 55 and 56 respectively above and below the plane of said string 48. Said cable tracts 49*a*, 50*a*, and 50*b*, 49*b* (in that order) form a single pulling element. When observed along an axis parallel to the axis of rotation 44*z* said tracts 49*a* and 49*b* coincide, said tracts 50*a* and 50*b* coincide and said tracts 49*a*, 49*b* and said tracts 50*a*, 50*b*, in the portion detached and away from said cam 44, form a variable internal angle of between approximately 150° and approximately 190°, during the operating cycle from the initial condition to the loaded condition and vice versa; this is more apparent in FIG. 10, in right-angle views from above of the two devices 700*b* shown in the two operating conditions, initial above and loaded below. What was stated above for the cam 44 on the left side of the device applies in a mirror-like fashion on the right side, for the cam 45, with cable 51-52, anchor 58, same linkages 55, 56 but right side, and limb 42 by means of element 42*i*, angling between said cable tracts 51*a*, 51*b* and said cable tracts 52*a*, 52*b* away from said cam 45.

Said cable tracts 49*a*, 50*a*, 49*b*, 50*b* and 51*a*, 52*a*, 51*b*, 52*b* are inclined with respect to a horizontal median plane and wound in a helical fashion around different diameters on the cams above and below the string guide, for approximately 3 turns, for simultaneously winding and unwinding. In particular, the cable tracts 49*a* and 49*b* operatively associated with said cam 44, wind around axial portions 44*z*3 and 44*z*4 of said cam, respectively, during loading. The tracts 50*a* and 50*b* are unwound from axial portions 44*z*7 and 44*z*8 with a smaller radius, during said same loading step. Said tracts 49*a* and 50*a* have approximately the same diverging inclination in the front direction. Said tracts 49*b* and 50*b* have a specular trend relative to a horizontal mid-plane. Portions 44*z*5 and 44*z*6 of said cam 44 join the two said portions 44*z*3, 44*z*7 and 44*z*4, 44*z*8, respectively, with the unwinding radius of the tracts 50*a* and 50*b* increasing to approximately the radius of said portions 44*z*3 and 44*z*4 simultaneously with the winding of said tracts 49*a* and 49*b*, in a final loading step. Said cables 49-50 are stably connected to the cam 44, by gluing, for a tract of the axial portions 44*z*3 and 44*z*4, wherein said tract 49*a* or 49*b* is not affected by detachment from the cam, respectively above and below the plane of the string 48. The same in a mirror-like fashion for tracts 51-52 around axial portions 45*z*3 and 45*z*4 of the cam 45 and portions 45*z*7 and 45*z*8 of the same cam, respectively, stable fixing on axial portions 45*z*3, 45*z*4, axial connecting portions 45*z*5 and 45*z*6. Each cam has two cylindrical axial portions, 44*z*1 and 44*z*2, one and 45*z*1 and 45*z*2 the other cam, positioned respectively above the string plane, z1, and below z2, with in-between a portion with larger diameter and limited by an upper and bottom flange. The portions z1 and z2 are designed to roll against the guides 46 and 47 and having a diameter substantially equal to that around which are wound, during loading, the cable tracts 49*a*, 49*b*, to the left, and 51*a*, 51*b*, to the right, coming respectively from the respective anchors 57 and 58. FIG. 9 does not include all the axial portions of one and the other of said cams 44 and 45; those missing portions can be inferred from the double horizontal and vertical symmetry of the device 700*b* and from the nomenclature criterion adopted.

Figure 11:
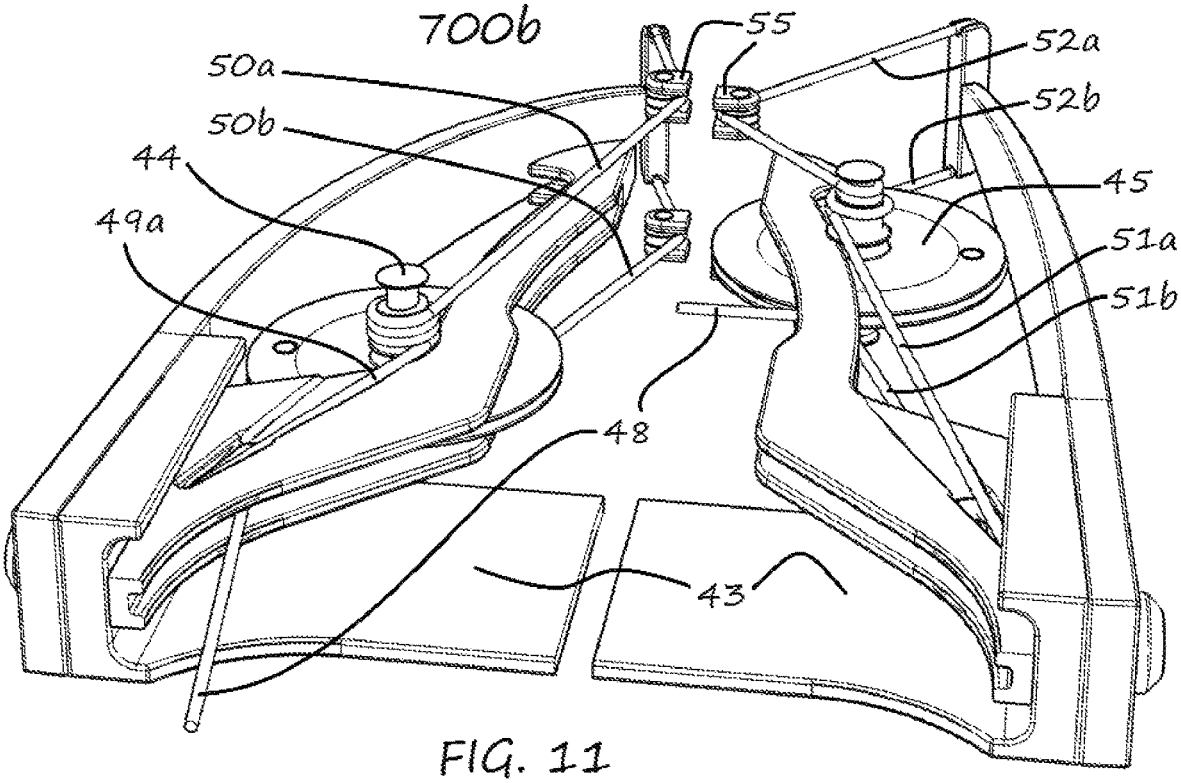
FIG. 11 illustrates an upper rear view of two halves of the second embodiment, one in a loaded condition and the other in an unloaded condition, placed side-by-side spaced apart for illustrating the operation.
Figure 12:
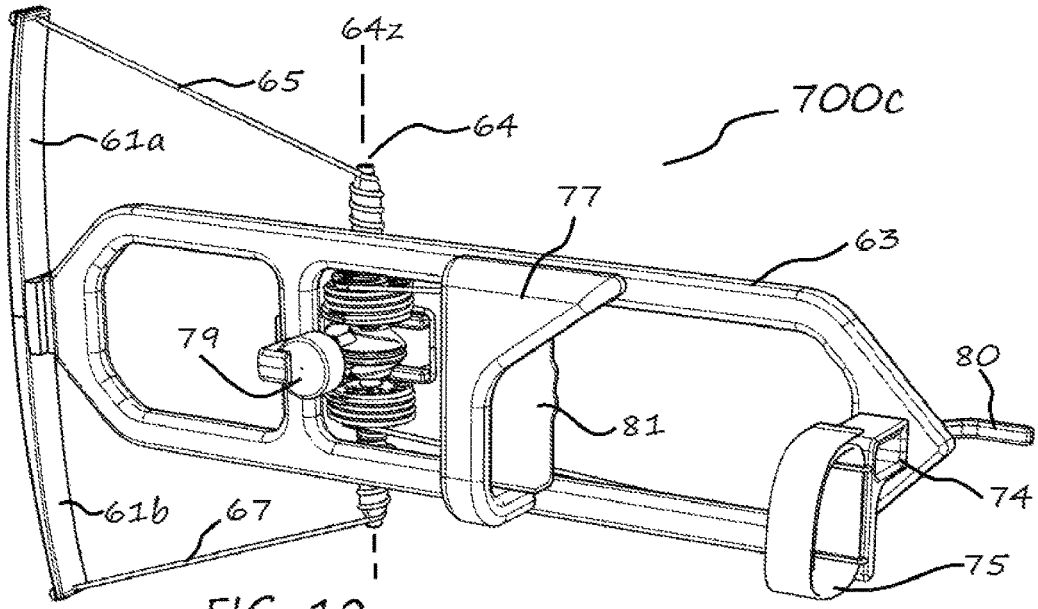
FIG. 12 illustrates a rear left perspective view of a third embodiment in an initial condition.

Operation. In an initial condition, FIGS. 7 and 9, said limbs 41 and 42 are preloaded and tension on said string 48 prevents the rotation of said cams 44 and 45. During the loading of the crossbow, the traction of the string 48 for a median zone imparts rotation to each of said cams 44, 45, which simultaneously unwind portions of tracts 50*a*, 50*b*, 52*a*, 52*b*, and wind around a larger diameter tracts of anchor cables, 49*a*, 49*b*, 51*a*, 51*b*. At the same time, each cam rolls against the guides 46 or 47 with the cylindrical axial portions 44*z*1 and 44*z*2 or 45*z*1 and 45*z*2, and translates backwards along said guides 46 or 47. The limb connected is drawn to the cam because the portions of cable tracts 50, 52 transferred are smaller than the portions of cable tracts 49, 51 wound and therefore of the consequent movement of the cam 44 or 45. At the same time, the cable diverters 55, 56 move forward, whilst portions of cable tracts slide relative to them. In a final step of the loading movement, the radius unwound by the cable tracts 50*a* and 50*b*, to the left, and 52*a* and 52*b*, to the right, increases, so as to reduce the loading force necessary in the step in which the limb opposes greater force to further deformation and modifying the force/draw curve measured at a median portion of the string 48. The device 700*b* in a loaded state, ready to launch, is illustrated in its entirety in FIG. 8. Movements in reverse to those mentioned above are performed on release of the string 48 so that the limbs are free to return to a condition with less accumulated elastic energy, accelerating the arrow 59 pushed by said string 48, simultaneously drawn by translation and recalled by winding. FIG. 10 shows two side-by-side right-angle views from above of the device 700*b* in two working positions. FIG. 11 shows side by side, at a certain distance, two halves of a device 700*b* in the two limit operating conditions, respectively, loading, the one on the left, in the image, and unloading, the one on the right. FIGS. 10 and 11 show the movements between one condition and another of the device 700*b*. In particular, the displacement of the winding of the cable tracts around the cams may be seen, in two positions translated relative to said cables having an inclination relative to a middle horizontal plane.

With respect to the first embodiment, the operating mode which sees the simultaneous unwinding and winding of cable tracts by each cam during each of the two loading or launching steps, extends the degree of design freedom in determining translation and rotary movements and transmission ratio, that is to say, force/draw curve. The advantage of reduced friction present in the first embodiment is substantially preserved since the radial speed at the cam-guide point of contact is substantially equal to the speed of translation. The rolling of said cams 44, 45 against said guides 46, 47 respectively increases the stability of said cams. Moreover, said guides 46 and 47 allow further modes of variation of the force/draw curve.

According to another embodiment, not described, the cable diverter elements 55 and 56 can have a different structure connected rigidly vertically, slidably delimited by front portions of said guides 46 and 47 or rigidly fixed on them, and said cable tracts 50 and 52 diverted to converge around the elements 41*i* and 42*i* vertically less extended. It is evident that the invention is equally applicable also to more classic crossbows with limbs facing backwards, both converging or diverging and for any orientation of the device in its use.

Figure 13:
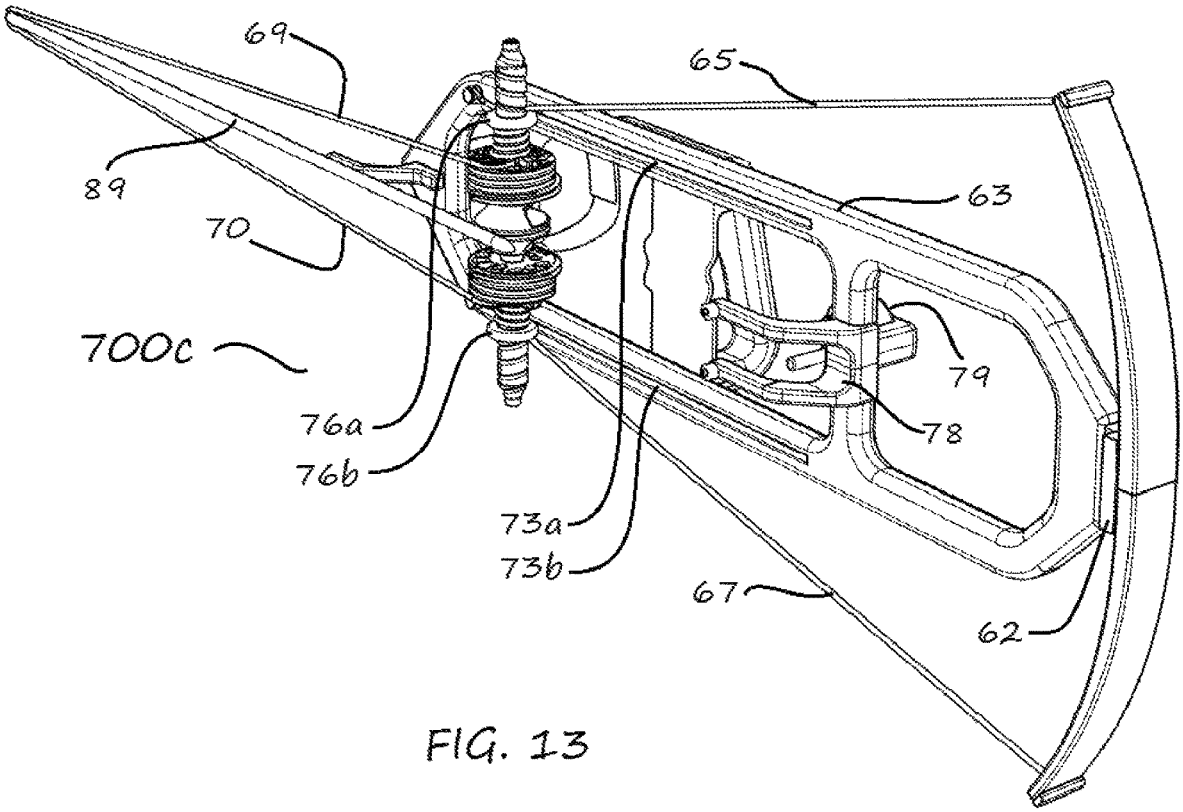
FIG. 13 illustrates a front right perspective view of the device of FIG. 12 in a loaded condition and an arrow with a simplified design.
Figure 14:
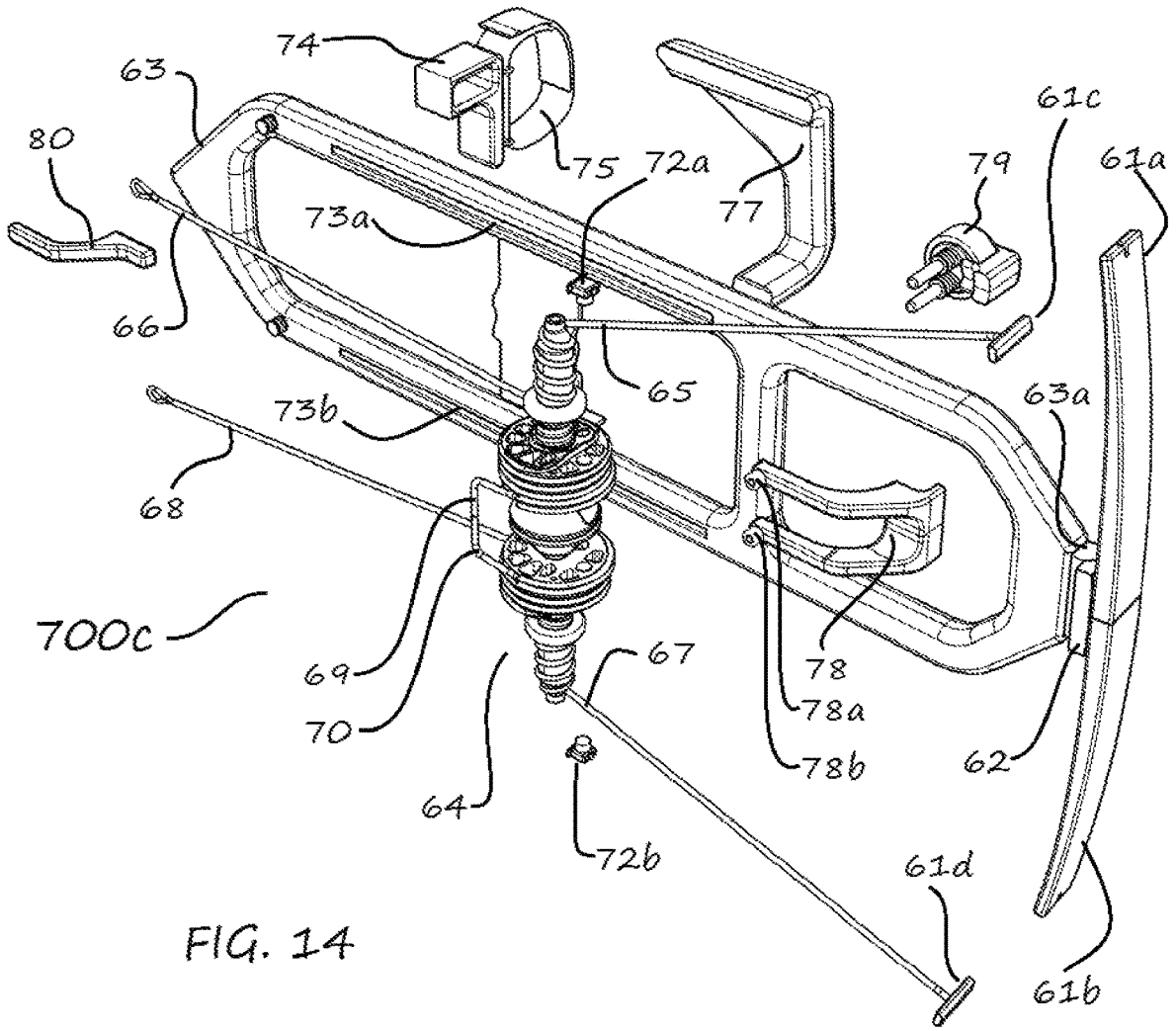
FIG. 14 illustrates an upper front right view of the device of FIG. 12 with components detached and spaced apart.

A third embodiment, labelled 700*c*, in the form of a bow, having an innovative configuration, is described below with reference to FIGS. 12 to 17*b*, according to the vertical orientation of the bending plane of the limbs typical of bows during their operation. The description and drawings refer to right-handed bow which is gripped with the left hand and wherein the right hand engages the string by pulling it; a bow for left-handed persons would be specular around a longitudinal vertical plane. Right and left references are from the point of view of the archer with the device ready to launch. An arrow with a simplified design 89, in FIGS. 13, 16*b*, 17*b*, is to be considered as prior art and representing any object to be launched. Said device 700*c* includes a rigid frame, 63, a single bending body, 61, divided into limbs 61*a* and 61*b* respectively upper and lower around a horizontal plane intersecting the axis of the arrow, and free to bend in the upper and lower end portions. Said limb 61 is fixed to the frame 63 in a middle portion, and can rotate relative to the frame about the vertical axis by means of supporting portion 62 and cylindrical joint 63*a* with a vertical axis. Said device 700*c* further including a single cam 64 according to the invention, oriented vertically, therefore with the axis of rotation parallel to the bending plane of the limbs, operatively connected to four cable tracts 65, 66, 67, 68 and two string tracts 69, 70. The tracts are arranged in a mirror-like fashion around the horizontal median plane. All the tracts have helical windings around said cam 64. The tracts 65 and 66, above the horizontal median plane, like the mirror-image ones 67 and 68, below, each connect the free end of the limb closest to the cam, 65 and 67, and said cam with a rear anchoring point, the tracts 66 and 68. In particular, said tracts 65 and 67 are respectively connected with their front end to the limb 61*a* and 61*b* by respective rigid connecting elements 61*c* and 61*d*, extending transversely for the width of the limb in the zone from which this is pulled and on the front face and are intended to distribute the tensile stress along the width of said limb 61. Said cable tracts 65 and 67 are unwound during a step for loading the bow whilst the tracts 66 and 68 are simultaneously wound. Both the windings 65 and 67 and the windings 66 and 68 have a helical trend with variable radius and pitch. That allows a change of the force-draw curve which opposes the natural increasing rigidity of the limbs during this loading step, thus facilitating the traction of the string. The string tracts 69, 70 have a helical winding with a larger diameter than the cable tracts. Inextensible tracts 71*a* and 71*b* are interposed between tracts 66 and 69, the first, and tracts 70 and 68, the second. Said tracts 71*a* and 71*b* are stably fixed to said cam 64 and not subject to deviations, by means of pressers 72*a* and 72*b*. Said pressers 72*a* or 72*b* consisting of a pin designed to be housed in a suitable vertical cavity in the cam and including a screw designed to keep pressed a pressure element which is axially uncoupled from said screw, in contact with the tract 71*a* or 71*b*, pushing it against the rear cam body. The tracts 66, 71*a*, 69, 70, 71*b*, 68 (in that order) form a single inextensible flexible element, which is at the same time cable and string in different portions of its extension, and has an end fixed to the frame 63 in a right rear area. The tracts 65 and 67 are each a single element with end fixed to the limb and cam. The six string and cable tracts interfaced with said cam 64 are therefore made with three substantially inextensible flexible continuous elements designed to withstand tension forces.

Said cam 64 includes in a median zone portions 64*a* and 64*b*, mirror-like with said median plane; these portions constituting a single concave cylindrical element 64*a*-64*b*, designed to receive, for resting and rolling, a radial portion of the arrow for its longitudinal extension in the various operating steps from loading to launching of the arrow. Said portion 64*a*-64*b* has a diameter approximately equal to the portion of cam 64 on which the string tracts 69 and 70 are wound.

Above and below the said portions 64*a*, 64*b*, said cam 64 integrates with a truncated cone extension 64*c* and 64*d*, respectively, with a decreasing radius away from the horizontal median plane and including a spiral recess ending in a vertical wall (81*a* and 81*b*), designed to determine an end of stroke position for said cam 64, stopping the movements, as described below.

Above and below said portions 64*c* and 64*d*, said cam 64 integrates portions with a cylindrical axial extension, 64*e*, 64*f*, respectively, designed to form surfaces for the helical winding of the string tracts 69 and 70 respectively. In an initial condition of the device 700*c*, said tracts are fully wound, for approximately four revolutions. Along a final portion closer to the horizontal median plane, extended for approximately half a turn, the winding of the tracts 69 and 70 around said cam portions 64*e* and 64*f*, include flexible lips, for example made from rubber, 64*m* and 64*n* designed to retain two portions of string adhering to the cam opposing modest resistance to accidental detachment. In a step of unwinding string tracts 69 and 70, during the loading of the device 700*c*, the tension on the string caused by the pulling of it by the archer exceeds the resistance of the lips to the detachment of said portions of string from said axial portions 64*e* and 64*f*. During launching, the force acting on the string in tension exceeds the resistance of the lips and the tracts 69 and 70 re-enter into contact with portions 64*e* and 64*f*. Above and below said portions 64*e* and 64*f*, said cam 64 integrates portions with irregular axial extension, 64*g*, 64*h* respectively, designed to form surfaces for the helical winding with variable radius and spacing of the cable tracts 66 and 68 respectively. In an initial condition said tracts are fully unwound, for approximately four revolutions. A portion for connecting with said portions 64*e*, 64*f* includes said tracts 71*a* and 71*b* held still against sliding by said pressers 72*a* and 72*b*.

Above and below said portions 64*g* and 64*h*, the cam 64 incorporates portions with cylindrical axial extension 64*i* and 64*j*, respectively, designed to act as a pin for two equal wheels, 76*a* and 76*b*, which are coaxial and free to rotate independently of the cam. Said wheels 76*a*, 76*b*, designed to roll against the double guide 73*a* and 73*b*, made as longitudinal recesses on the right side of the frame 63, during loading and launching, resting against it by the force of the limbs 61*a* and 61 *b* transmitted by the cables which are suitably inclined with respect to the vertical longitudinal plane and already tensioned in a first initial condition with pre-loaded limbs.

Above and below said portions 64*i* and 64*j*, said cam 64 integrates portions with irregular axial extension, 64*k*, 64*h* respectively, designed to form surfaces for the helical winding with variable radius and spacing of the cable tracts 65 and 67 respectively. In an initial condition said tracts are fully wound, for approximately four revolutions. An end portion of said tracts 65, 67 being stably fixed to the cam in an area proximal to said portions 64*i*, 64*j*.

The cam 64 is therefore offset to the right of the frame 63 and the limb 61. The cam rotates in a clockwise direction during a loading step, viewed from above and translates parallel to the frame 63 in a rear direction, away from the limb 61, during said loading step. The string 69-70 extends from the cam 64 on the right side whilst it is pulled away by said limbs 61*a* and 61*b* and substantially parallel with the frame 63.

Said cam 64 (more clearly, in an upper front perspective detail shown in FIG. 15), as it has to meet requirements of reduced mass, is made from a substantially rigid, hollow cylindrical body (tubular), made of carbon fibre and an outer plastic coating, charged with carbon, from sintering (3D printing, that is to say, additional manufacturing processes). Said portions 64*e*, 64*f* and coupling with portions 64*g* and 64*h*, including lightening cavities. Said tubular body houses high pressure gas in a relative sealed axial cavity, this increases the rigidity and the radial strength. Other construction materials and techniques can be implemented. In particular, the coating of the tubular core may be made by moulding of plastic materials. Said cam 64 constitutes a single integral rotational body.

An element 78 is fixed to the frame 63, in a zone in front of the cam 64 in its position with the device in the initial condition. Two protrusions, above and below the horizontal median plane, extend in front of and to the right side of the cam and project in a rear direction two arms which support at their ends two wheels 78*a* and 78*b* in abutment against the string above and below the median point of said string 69-70, keeping a median portion separate from the body of the cam, preventing the unwinding and the auto-rotation of the cam and orienting said string 69-70 in the direction of launching the arrow, basically parallel to the frame 63, offset to the right.

A decelerating element 79 is fixed to the frame 63 in the vicinity of the cam 64 in its advanced position corresponding to the initial condition of the device 700*c*. The function of said decelerator 79 is to absorb the residual kinetic energy of the cam at the end of the launching step. In general, this apparatus is similar to those of the prior art in use in the industrial sector of linear movement apparatuses. More specifically, two parallel cylinders 79*a* and 79*b*, above and below the horizontal median plane, receive the impact of said cam 64 with walls 81*a* and 81*b*, at the last steps of rotation and longitudinal translation of said cam 64. The impact pushes the cylinders which push a disc 79*e* which slides in an airtight fashion inside a cylindrical cavity 79*f* containing air and closed except for a hole 79*h* with a small diameter and delimited by a cylindrical body 79*g*. At the moment of impact the air cannot flow freely from the cavity and is compressed opposing resistance to further forward movement of the cylinders. The reset of the decelerating device for a new cycle is ensured by the springs 79*c* and 79*d* as soon as the pressure of the cam is removed at an initial moment of the loading step of the device 700*c*. Outside air freely enters in the cavity. The decelerator 79 supports the function of the element 78 in delimiting the movements of the cam 64 and is more suited for high residual energy levels due also to the significant twisting moments which the residual energy acting on the string would impose on the arms 78.

An arrow supporting element 80 is fixed to the frame 63 in a relative rear zone and on the right side. Its purpose is to create an aid to the correct orientation of the arrow through the simultaneous alignment of it by resting against said element 80 and said surface 64*a*-64*b*.

A handgrip 77 for the left hand supporting the bow is fixed to the left side of the frame 63, thus on the opposite side to that along which said cam 64 translates. Said handgrip 77 having an oblique trend being inclined with the lower portion more offset to the left of said frame 63 with respect to the upper portion. The thumb of the hand lies at a height just below the horizontal median plane and the arrow in the condition ready for launch, and is just left of the vertical plane of said string 69-70.

A plate 81 is fixed to said frame 63 to the right of the handgrip 77 to protect the left hand gripping the bow from said cam 64 and from the arrow 89 during launching, delimiting the space free from interference available for the hand.

Said frame 63 supports on the left side a supporting element 74, which can be repositioned longitudinally including a flexible belt 75, which can be closed by means of Velcro, designed to be fixed around the forearm of the arm which supports the bow. Said element 74 is designed to act as a support in contrast with the force moment about the vertical axis on said handgrip 77. Said belt 75 further allows the archer to have the left hand free without having to place the device 700*c* at least whilst said device 700*c* is not concurrently used.

Operation. A particular feature of this embodiment, 700*c*, is the positioning of said cam 64 and said string 69-70, in its median portion of pushing the arrow, in an advanced position with respect to said handgrip 77 of the device 700*c*, along a longitudinal axis substantially parallel to the direction of launching, with the bow in its initial condition, which is also the end of stroke position of said cam 64 at the end of its translation after launching the arrow, so that the bow is characterised by a launching stroke, the so-called "draw length" or "power stroke" which is increased with respect to the prior art bows and for the same physical characteristics of the archer. Another particular feature is the horizontal offsetting of the string relative to the handgrip and the consequent twisting moment acting on the handgrip 77 and therefore on the hand of the archer. The extent of the twisting moment varies with the tension on the string and the minimum right-angled offset between the direction of force deriving from said string 69-70 (its portion unwound from said cam 64) and said handgrip 77.

Figure 15:
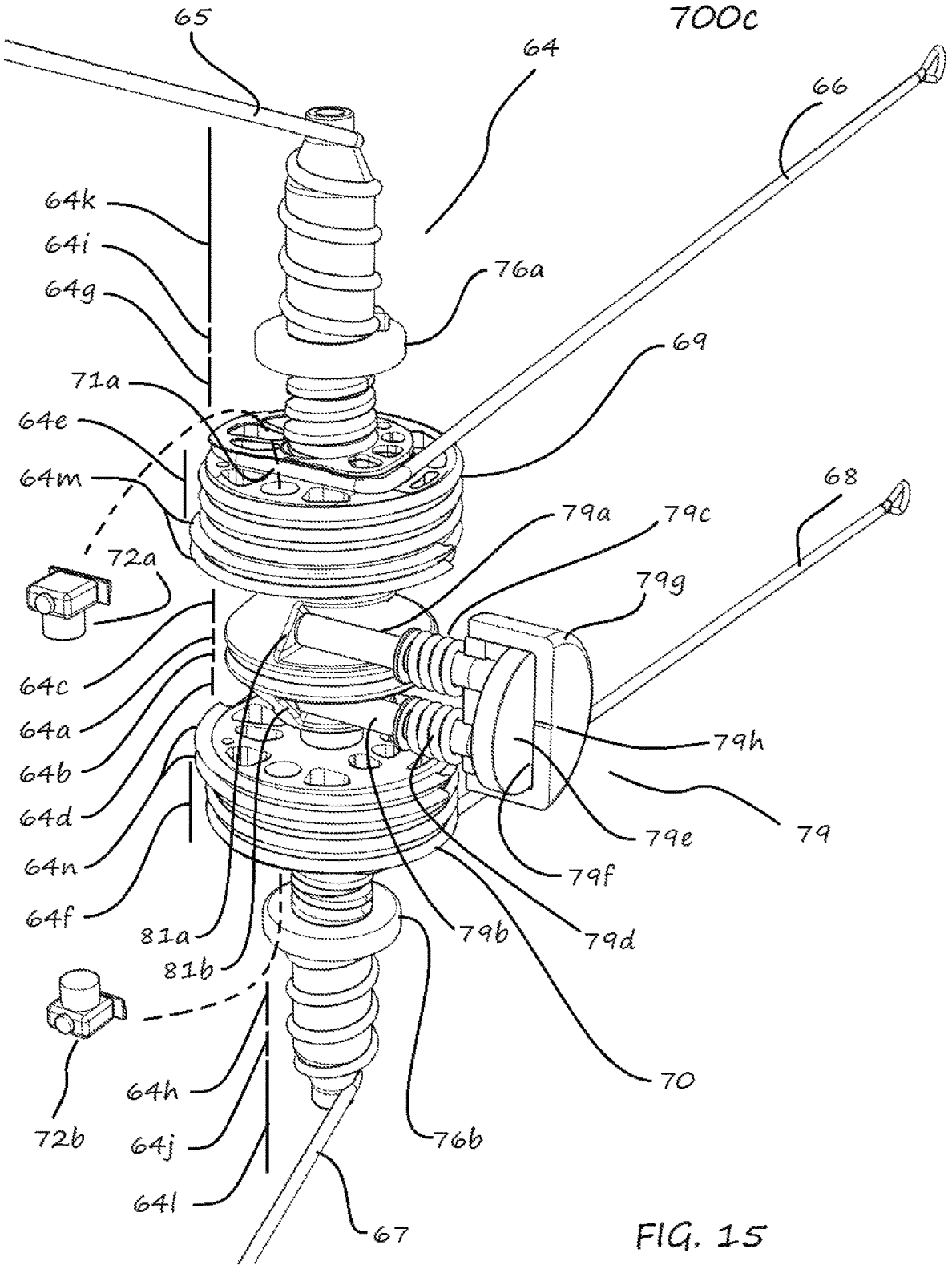
FIG. 15 illustrates an enlarged upper front left view of a detail of the third embodiment, with components removed, cut, detached and spaced apart.

In order to load the device 700*c*, according to a first technique, the device is gripped with the left hand at the handgrip 77 and with the belt 75 clamped around the left forearm resting on the support 74. The device is in an initial condition, shown in FIG. 12, wherein the potential elastic energy accumulated in said limbs 61*a* and 61*b* is minimal. The string 69-70 is engaged with the fingers of the right hand directly or by means of a prior art releaser, maintained in its median portion spaced from the body of the cam 64, by means of said spacer 78, then pulled away from the contact element against said spacer 78, in particular its wheels 78*a* and 78*b*. The left forearm supporting the bow is brought close to the abdomen with the direction of launch aimed towards the right. The arrow is nocked on the string in the relative median portion, initially oriented towards the right or passing the plane of the frame 63 in front of the cam 64 or intersecting said plane in a front zone relative to said frame 63 and said limb 61; the arrow and the string are therefore not on the same vertical plane. The string 69-70 is drawn with the right hand whilst the left supports the bow, with a movement which moves the two hands away from one another whilst in front of the abdomen; in this step, the string is very angled with respect to the launching arrangement; in effect, it is almost opposite. The pulling force applied by the string 69-70 rotates said cam 64 about its axis 64*z*, winding portions of cable tracts 66 and 68, placed between the cam and a rear anchor to the frame 63, and simultaneously unwinding smaller portions of cable tracts 65 and 67 between limb and cam. During an initial step of loading said device 700*c* winding of the portions 66 and 68 has a much greater radius than those of the portions 65 and 67. Whilst it rotates, said cam 64 translates backwards. The angle of the cables with respect to a vertical plane is such that on said cam 64 a net component of force acts towards the left therefore against the guide 73*a*, 73*b* on the right side of the frame 63; the cam rolls against said guide with its wheels free 76*a* and 76*b*. Conveniently, in this initial step of loading the working ends of the limbs, they are pulled to move backwards a relatively large distance with respect to the moving backwards of the cam using the reduced initial stiffness of the limb. As soon as the cam moves from the support against said impact cylinders 79*a* and 79*b* of said decelerator 79 these are free to move to the right pushed by springs 79*c* and 79*d*, thus expanding the cavity 79*f*, so that air flows through the hole 79*h* and resetting the decelerator for the next impact. FIG. 15 shows the interaction between said cam 64 and the decelerator 79 in an initial condition of said device 700*c* and in a front upper left perspective view with components removed and with said decelerator 79 partly cut.

Continuing in the loading, by applying a force to move said handgrip 77 and the median portion of said string 69-70, that is, the left hand and right hand away from each other, the translating movement of the cam supports the opening movement of the left arm necessary to move the bow to the final position before launching which is the same as that typical of prior art bows with the left arm taught in the launching direction and the right located close to the face. In particular, whilst the vertical plane of said string 69-70 rotates relative to the frame, in a clockwise direction from the point of view of the archer, and the two hands move away, the cam 64 translating towards a more withdrawn zone of the frame 63 remains substantially aligned between the two points from which the force is exerted, the left hand at the handgrip 77 and the right hand at the string 69-70 (median zone). Twisting moments of force are opposed by the resting of the left forearm, in an area close to the elbow, against said element 74; the twisting moments no longer act on the wrist but on the arm and on the shoulder.

The final step of the loading is carried out with movements similar to those used with prior art bows until reaching an arrangement and configuration of the bow-archer system which is similar to that of prior art bows. The radius of the windings is also designed according to the ergonomics of use, that is to say, the force which can be applied by the archer in the various steps of the movement. In an intermediate step, when the string is close to an angle of 90° with respect to the frame 63, as a function of the various technical and operational considerations there could be a temporary detachment of the cam 64 from the guides 73*a* and 73*b*; this does not affect the operation since the forces acting on said cam 64 are in any case substantially symmetrical. In fact, the function of the guide is for support and stabilisation but is not strictly necessary either during loading or launching. The arrow 89 which initially pointed forwards and was considerably angled with respect to the vertical plane of the string 69-70 is gradually rotated around the engagement portion of said string 69-70. ideally, the arrow is brought into contact with the rolling guide 64*a*-64*b* as soon as possible. The launching condition of said device 700*c* sees the arrow resting simultaneously against said roto-translational guide 64*a*-64*b*, and said element 80 fixed to the frame 63 in a rear right zone (FIGS. 13, 16*b*, 17*b*), thereby determining fixed references (between one operating cycle and another) which inform the archer of the correct relative orientation and allow more efficient aiming in combination with any technique, method or target apparatus.

During the entire loading, the limb 61 (61*a* and 61*b*) rotates with the element 62 about a vertical axis to the joint 63*a* supporting the different angle which the vertical bending plane determined by the cables 65 and 67 unwound from the cam 64 adopt relative to the frame 63 or to the plane of the unwound string 69-70, whilst the cam 64 translates. This is seen more clearly from the comparison of the comparative right-angled views from above of FIGS. 16*a*, 16*b*, 17*a* and 17*b*. In particular, the reduction of this angle from the start of the loading, until its completion, opportunely compensates for, at least partly, the tension on the cables which is a maximum in a second half of the step (for a typical ergonomic shaped profile) and therefore determines a reduced force by said cam 64 at right angles against the frame 63 (wheels 76*a* and 76*b* rolling against guides 73*a* and 73*b*), thus reducing the sliding force of said wheels 76*a* and 76*b* against their pivoting on said cam 64.

At the end of loading the device 700*c* it is in a condition of maximum potential elastic energy and ready for launching the arrow; the string 69-70 is approximately parallel to the frame 63, the transversal deviation between force line of the string and the handgrip 77 is reduced. At the same time, the tension on the string is reduced by a considerable degree by suitable design of the windings. The twisting moment on the handgrip 77 is minimal and opposed by the support of the forearm against the element 74.

Summing up, the loading, according to the technique described, starts with hands close together in front of the archer, close to the body. Subsequently, the left arm, in particular, rotates away from the body, the string 69-70, in its portion unwound from the cam 64, rotates relative to the frame 63. The arrow nocked on the string 69-70 rotates relative to the string 69-70 and to the frame 63. The cam 64 withdraws along the frame 63, remaining substantially interposed between the two hands, reducing twisting moments of the handgrip 77 and the support of the left forearm against the element 74 until the end of the loading and the reaching of the correct orientations of string and arrow, the archer having been able to exert force for a more extended movement, having expended less energy in friction. The same loading of the device described can occur alternatively with a second technique and other movements, more similar to those performed using prior art bows. Specifically, the bow is initially pointed downwards and forwards when the archer engages the string and starts to continue with the same orientation until the movement converges with those performed for prior art bows. According to this second technique, the twisting moment acting on the handgrip 77 is opposed in its entirety by the resting of the forearm against the element 74.

Other loading techniques could be used only with the only requirement that the string 69-70 must be spaced with respect to the cam 64 and other obvious functional requirements of non-interference and safeguarding.

When the archer releases said string 69-70, the launch step starts. The tension on the cables creates a torque on said cam 64 which rotates about its axis 64*z* and translates forwards winding and pulling at the same time, the portion of the string 69-70 unwound previously, rolls against the guide 73*a* and 73*b* with wheels 76*a* and 76*b* with reduced radial force and friction, and pushes the nocked arrow which runs with minimal force against element 80 (only in the initial step) and rolls without friction against guide 64*a*-64*b*. At an advanced step of the launching said string 69-70 comes into contact with the wheels 78*a* and 78*b* engaging them, sliding against them and making them rotate. Advancing further, said string 69-70 also transmits a radial moment at approximately right angles from the string at the point of contact, which the arms of the element 78 support. During the final step of launching the cam has a maximum energy. Immediately before the string 69-70 runs out of its unwound portion impacting against element 78, wheels 78*a* and 78*b*, with all the residual energy of the kinematic chain, considerably stressing the element 78, the cam impacts on the walls 81*a* and 81*b* against cylinders 79*a* and 79*b* of the decelerator 79 and sees the relative movements rapidly reduce, until they are completely stopped. The string 69-70 impacts elements 78*a* and 78*b* so that the portion unwound is minimal, with only its inertia. In the meantime, the arrow has been detached from the string 69-70 and continues ballistically.

This embodiment is advantageous since it reduces the friction components and increases the elongation with the same distance between left hand and right hand in the launching arrangement and therefore for the same height and measurements of the archer and same maximum force. This results in a bow of greater energy efficiency (ratio between kinetic energy of the arrow and energy expended in the loading) thanks both to the overall reduction in friction and the greater elongation, and also greater energy stored, in absolute terms, thanks to the increased loading stroke. This results in a greater speed of the arrow with all the physical parameters of the archery device being the same.

According to a variant of the third embodiment, not described, the direction of rotation of the cam 64 is inverted, so that the arrow is closer to the left hand. This is advantageous because it reduces the twisting moment on the handgrip 77. According to yet other embodiments of the invention, the frame 63 includes portions extended behind which interface, held or supported with the right hand pulling the string 69-70 or with the chin or chest of the archer; this allows the archer to more effectively contrast said twisting moment during the launching of the arrow. According to yet another embodiment, the device 700*c* is mounted on a shaft designed to maintain the loaded condition, opposing resistance to the tension coming from the string engaged to a release mechanism, and it is, functionally, a crossbow.

The methods of rolling the cam against a guide described for the second and third embodiments can be equally implemented on the first embodiment having different operation of the windings. According to other embodiments of the invention, not illustrated, the cams are pivoted to, or rested on, the limbs or the structure which supports the limbs, whilst maintaining the configuration described and the relative advantages described. The windings can be planes without overlapping or spiral or helical or in any combination. The inclination of any cable tract, relative to the plane of rotation, can be different (in terms of size and direction) from that illustrated by way of example. According to other embodiments, the guides for the cam can be integrated with the limbs and therefore at least one cam rolls on the outside spine of at least one limb.

The three embodiments described aim to represent a summary, of the possibilities created, and the invention itself is applicable to any bows and crossbows, with any number or orientation of the limbs and any direction of rotation of the at least one cam rotatably interfaced with at least one string tract and at least two cable tracts, the at least two cable tracts in different directions projected at right angles on the plane of rotation, for at least part of the operating cycle.

The invention claimed is:

1. An archery device for transmitting power from at least one limb of a bow or crossbow, to an arrow, said archery device comprising:

at least one cam rotatable about an axis, and at least one flexible, substantially inextensible element comprising a string and at least one cable, said at least one cable comprising a cable tract connected to at least one portion of said at least one limb and extending from said at least one limb to said at least one cam and a further cable tract extending from said at least one cam to a horizontal median plane of said archery device, said string comprising at least one string tract connected to said at least one cam in such a way as to impart a rotational movement to said at least one cam when said string is pulled away from said at least one limb, said rotational movement forcing said at least one cable to wind about said at least one cam in such a way as to actuate a movement of said at least one cam to said at least one limb, wherein said at least one cam is solely suspended on said cable tract and on said further cable tract, said cable tract and said further cable tract being adapted to wind or unwind around said at least one cam.

2. The archery device according to claim 1, wherein said at least one cam rolls against a guide with at least one portion of an extension of said at least one cam along said axis.

3. The archery device according to claim 1, wherein both of said cable tract and said further cable tract are wound during loading of the bow.

4. The archery device according to claim 1, wherein at least one chosen from said cable tract and said further cable tract is unwound from said at least one cam during loading of the bow, and wherein at least two of said cable tract and said further cable tract are wound or unwound around paths having different radiuses for at least part of an operating cycle of said at least one cam.

5. The archery device according to claim 1, and further comprising an element, wherein at least one portion of at least one chosen from said cable tract and said further cable tract is deviated, inclined, returned or anchored by the element supported by said at least one chosen from said cable tract and said further cable tract.

6. The archery device according to claim 1, wherein said at least one cam is pivoted on any support.

7. The archery device according to claim 1, wherein said at least one cable also comprises a transit portion stably housed in a central body of said at least one cam and configured to keep said at least one cam in suspension.

* * * * *